US010501906B2

(12) United States Patent
Spry

(10) Patent No.: US 10,501,906 B2
(45) Date of Patent: Dec. 10, 2019

(54) TRENCHING PANELS, PANEL ASSEMBLY, SYSTEM AND METHOD

(71) Applicant: Peter Robert Spry, Eagle Vale (AU)

(72) Inventor: Peter Robert Spry, Eagle Vale (AU)

( * ) Notice: Subject to any disclaimer, the term of this patent is extended or adjusted under 35 U.S.C. 154(b) by 0 days.

(21) Appl. No.: 15/434,136

(22) Filed: Feb. 16, 2017

(65) Prior Publication Data

US 2017/0159258 A1 Jun. 8, 2017

Related U.S. Application Data

(62) Division of application No. 14/881,197, filed on Oct. 13, 2015, now abandoned.

(30) Foreign Application Priority Data

Oct. 17, 2014 (AU) ..... 2014904145

(51) Int. Cl.
*E02D 17/08* (2006.01)

(52) U.S. Cl.
CPC ..... *E02D 17/08* (2013.01); *E02D 17/083* (2013.01); *E02D 2220/00* (2013.01)

(58) Field of Classification Search
CPC combination set(s) only.
See application file for complete search history.

(56) References Cited

U.S. PATENT DOCUMENTS 640,377 A * 1/1900 Haentges ..... E02D 29/0216 405/273
1,794,704 A 3/1931 Miller
1,880,316 A 10/1932 Dancer
2,808,624 A * 10/1957 Sullivan ..... E04B 1/6116 52/396.06
2,865,178 A 12/1958 Wicke
4,022,420 A * 5/1977 Pace ..... E04G 9/06 249/189
4,199,278 A * 4/1980 Koehl ..... E02D 17/08 405/282
4,274,763 A * 6/1981 Krings ..... E02D 17/08 405/282
7,559,724 B1 * 7/2009 Olen ..... E02D 17/08 405/272
2004/0208702 A1 * 10/2004 Buchanan ..... E02B 3/06 405/15
2010/0034597 A1 * 2/2010 Kundel, Sr. ..... E02D 17/08 405/283
2014/0248093 A1 9/2014 Breen

* cited by examiner

*Primary Examiner* — Kyle Armstrong
(74) *Attorney, Agent, or Firm* — Rankin, Hill & Clark LLP

(57) ABSTRACT

A panel for shoring a wall of a trench, the panel including an outer face arranged to face the wall, an opposing inner face, opposing sides, a top end and a bottom end, wherein the panel includes fixed couplings located at or adjacent to the inner face and toward the opposing sides, the fixed couplings being adapted to couple with a removable coupling which is inter-connectable in a first installed condition between a respective one of the fixed couplings of the panel and a respective one of the fixed couplings of an adjacent further panel. A panel assembly including at least two panels and a removable coupling is also disclosed as well as a system and method including interchangeable panels and couplings that allow for the formation of trenching supports in a variety of geometric configurations.

15 Claims, 20 Drawing Sheets

TRENCHING PANELS, PANEL ASSEMBLY, SYSTEM AND METHOD

RELATED APPLICATIONS

This application claims priority from Australian provisional patent application no. 2014904145 filed on 17 Oct. 2014, the contents of which are incorporated herein by reference.

TECHNICAL FIELD

The invention relates to a trenching panel, a panel assembly, a trenching system and a method of trenching using a trenching system.

BACKGROUND

Trenches are required to be supported or shored whilst open to prevent the collapse of walls of the trench. This allows the safe installation of piping and cabling in the trench. To support the trench, trenching supports, also referred to as trench boxes, may be used. Such trenching supports include two wall support panels that are connected via a brace that spans between the two wall support panels.

In use, the assembled trenching support may be lowered into the trench with the two wall support panels being located adjacent the walls of the trench and the brace arranged to span the width of the trench. The two wall support panels may, for example, have a height of two and half metres and a length of about 1 metre. For long trenches multiples of the trenching supports may be used and placed alongside each other lengthwise along the trench.

A problem with these trenching supports relates to the weight of the trenching supports that are typically preassembled and it is often required to use a crane or lifting machine to lower the trenching supports into the trench. The use of a crane may be expensive, and crane access may in some situations be limited or not available.

Another problem with these trenching supports relates to the adaptability of the trenching supports to trenches of different shapes, lengths, heights, widths and installation situations.

The invention disclosed herein seeks to overcome one or more of the above identified problems or at least provide a useful alternative.

SUMMARY

In accordance with a first main aspect there is provided, a panel for shoring a wall of a trench, the panel including an outer face arranged to face the wall, an opposing inner face, opposing sides, a top end and a bottom end, wherein the panel includes fixed couplings located at or adjacent to the inner face and toward the opposing sides, the fixed couplings being adapted to couple with a removable coupling which is inter-connectable in a first installed condition between a respective one of the fixed couplings of the panel and a respective one of the fixed couplings of an adjacent further panel.

In another aspect, the fixed couplings are arranged such that adjacent sides of the panel and an adjacent further panel substantially abut with one another in the first installed condition.

In yet another aspect, the fixed couplings are arranged such that in the first installed condition the removable coupling extends at least partially across inner faces of the panel and the adjacent further panel between the respective fixed couplings thereof such that when a force applied to the outer faces of the panel and adjacent further panel, the removable coupling is placed in tension and the respective adjacent opposing sides of the panel and the adjacent further panel move toward one another into compression.

In yet another aspect, the fixed couplings are located so as to be accessible from at least one of the inner face and the top end thereby allowing decoupling of the panel assembly to a disassembled condition from the first installed condition from a position within the trench.

In yet another aspect, the fixed couplings are each provided in the form of at least one of a slot, channel and recess adapted to receive and couple with the removable coupling in the first installed condition.

In yet another aspect, the fixed couplings are provided in the form of slots that each extend along the inner face between the top and bottom ends and toward respective opposing sides of the panel.

In yet another aspect, the panel includes a strut coupling portion adapted to couple with a removable strut that spans the trench to an opposing panel at an opposing side of the trench in the first installed condition.

In yet another aspect, the fixed coupling is located relative the inner face such that in the installed condition the releasable coupling extends along the inner faces between the panel and adjacent further panel so as to be placed in tension by a force applied to the outer faces of the panel and adjacent further panel.

In yet another aspect, the fixed coupling is provided in the form of two slots that each at least partially extend along the inner face between the top and bottom ends and toward respective opposing sides of the panel.

In yet another aspect, the fixed coupling is arranged such that in the first installed condition the panel and an adjacent further panel are substantially fixed relatively to one another.

In yet another aspect, the fixed coupling is arranged such that in the first installed condition the removable coupling extends at least partially across inner faces of the panel and the adjacent further panel between the respective fixed couplings thereof.

In yet another aspect, the fixed coupling is arranged to pivotally couple with the removable coupling such that the panel is pivotable from the first installed condition, in which the panel and adjacent further panel are in a linear side-by-side arrangement, to a second installed condition in which the panel and adjacent further panels are angled relative to one another.

In yet another aspect, the panel includes at least two fixed couplings, each of the at least two fixed couplings being located at or adjacent to each of the opposing sides of the panel.

In yet another aspect, the fixed coupling part is arranged to pivotally couple with the fixed coupling part such that the panel is pivotable from the first installed condition, in which the panel and adjacent further panel are in a side-by-side arrangement, to a second installed condition in which the panel and adjacent further panels are angled relative to one another.

In yet another aspect, the fixed coupling is located in a recess in the inner face.

In accordance with a second main aspect there is provided, a panel assembly or system including at least two panels as defined above.

In accordance with a third main aspect there is provided, a panel assembly for trenching, the panel assembly including a first panel attachable in a side-by-side arrangement by a releasable coupling arrangement to a second panel in an installed condition in which an outer face of each of the first and second panels are locatable against a wall of the trench, wherein the releasable coupling arrangement includes a removable coupling arranged so as to be accessible from at least one of inner faces and top ends of the first and second panels thereby allowing at least one of coupling and decoupling of the first and second panels from a position within the trench.

In an aspect, each of the first and second panels include fixed couplings located at or adjacent to the inner faces and toward the opposing sides of the first and second panels, the fixed couplings being arranged such that in the installed condition the adjacent opposing sides of the first and the second panels substantially abut with one another with the removable coupling spanning across the respective inner faces between the first and the second panels.

In another aspect, each of the first and second panels includes fixed couplings located at or adjacent to the inner faces and toward the opposing sides of the first and second panels, wherein the in the installed condition the removable coupling is arranged to coupling extend at least partially across inner faces of the first panel and the second panel between the respective fixed couplings thereof such that when a force applied to outer faces of the panel and adjacent further panel, the removable coupling is placed in tension and the respective adjacent opposing sides of the panel and the adjacent further panel move toward one another into compression.

In yet another aspect, the releasable coupling arrangement is configurable between a first configuration in which the first and second panels are at a first installed angle relative to one another, and a second configuration in which the first and second panels are at a second installed angle relative to one another.

In yet another aspect, the releasable coupling arrangement is configurable by interchanging the removable coupling with another removable coupling arranged to angle the first and second panels relative to one another.

In yet another aspect, the first installed angle is about 0 degrees with the panels being parallel with one another and wherein the second installed angle is up to about 90 degrees in either direction in which the panels are substantially perpendicular with one another.

In yet another aspect, the releasable coupling arrangement includes fixed couplings carried by each of the first and second panels and the removable coupling is adapted to interconnect the fixed couplings of adjacent first and second panels in the installed condition.

In yet another aspect, the fixed coupling of each panel is provided in the form of two slots, each of the two slots being located toward respective opposing sides of the panel and at least partially extending along the inner faces of the panels between the top and bottom ends of the panel.

In yet another aspect, the removable coupling is provided in the form of a coupling member having spaced apart projections that are each respectively received by one of the two corresponding slots of adjacently arranged first and second panels in the installed condition, the coupling member thereby spanning between adjacently arranged first and second panels along the inner faces thereof.

In yet another aspect, the releasable coupling includes fixed coupling parts carried by each of the first and second panels and a removable coupling part which hingedly interconnects the fixed coupling parts in the installed condition.

In yet another aspect, wherein the releasable coupling is a double hinge.

In yet another aspect, the releasable coupling is arranged in a first configuration so as to allow pivoting of the first and second panels a first direction in which the inner faces of the first and second panels move relatively toward one another.

In yet another aspect, the releasable coupling is arranged to allow hinging movement of the first panel relative to the second panel.

In accordance with a fourth main aspect there is provided, a trenching system for shoring opposing walls of a trench, the trenching system including: a plurality of interchangeable panels having fixed couplings located toward opposing sides of the panels; and a plurality of removable couplings arranged to interconnect and span between the fixed couplings of adjacently arranged panels, wherein the plurality of removable couplings are configured to couple the plurality of interchangeable panels in at least one of a first configuration wherein adjacently arranged panels are parallel with one another and a second configuration wherein the adjacently arranged panels are angled relative to one another.

In an aspect, the removable couplings are interchangeable and are of different sizes and configurations to couple between the adjacently arranged panels in the respective first and second configurations.

In another aspect, the system further includes a removable strut and at least one of the panels locatable on each of the opposing walls of the trench include strut coupling portions to couple with the strut.

In yet another aspect, the system further includes removable pins, and the fixed coupling parts and removable couplings each include corresponding apertures to receive the pins.

In yet another aspect, the system further includes at least one of a wedge or corner post arranged to fit between the opposing sides of adjacently arranged in the second configuration.

In accordance with a fifth broad aspect there is provided, a trenching system for shoring opposing walls of a trench, the trenching system including at least two side panel assemblies adapted to be locatable in an installed condition with outer faces thereof adjacent to opposing walls of the trench with a removable strut arranged to span between and support the at least two side panel assemblies, wherein each of the at least two side panel assemblies includes a first panel coupled to a second panel in the installed condition by a releasable coupling, wherein the releasable coupling is arranged so as to be accessible from inner faces of the at least two side panel assemblies thereby allowing decoupling of the panel assembly to a disassembled condition from the installed condition.

In accordance with a sixth main aspect there is provided, method for shoring walls of a trench using a trenching system including a plurality of panels, the method including the steps of: coupling at least two adjacent panels together to form a panel assembly by fitting a removable coupling between fixed couplings carried by each of the adjacent panels; locating the panel assembly against at least one of the walls of a trench; and supporting the panel assembly by coupling the panel assembly to at least one of a further panel, panel assembly or strut extending laterally across the trench.

BRIEF DESCRIPTION OF THE FIGURES

The invention is described, by way of non-limiting example only, by reference to the accompanying figures, in which;

FIG. 25*b* is a top view illustrating the angled coupling for forming the a box or rectangular shaped trenching system as shown in FIG. 25*a;*

FIG. 25*c* is a top view illustrating the straight coupling as shown in FIG. 25*a;*

FIGS. 26*b* and 26*c* are a top views illustrating the angled coupling members for forming the non-straight or curved shape trenching system as shown in FIG. 26*a;*

DETAILED DESCRIPTION

Figure 1:
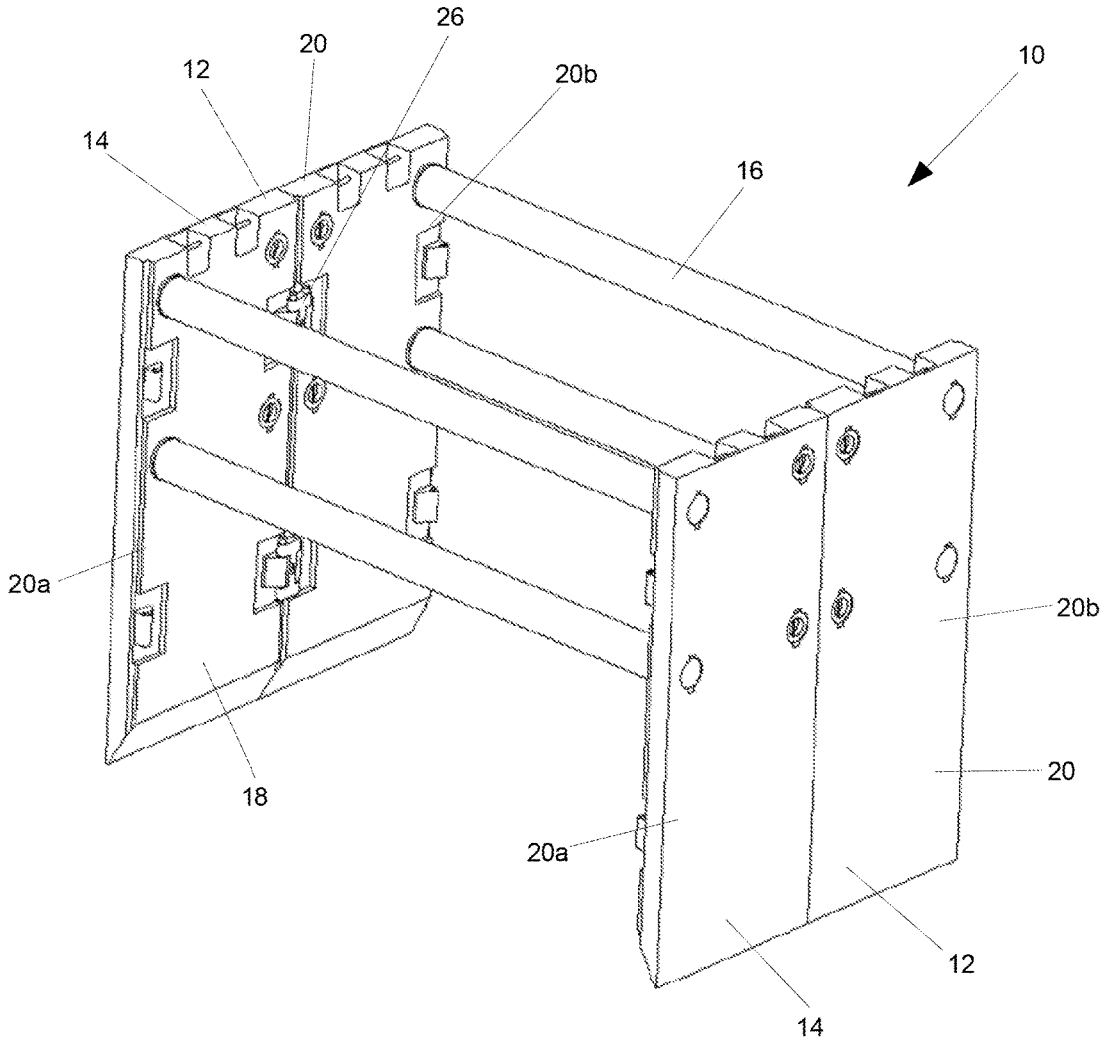
FIG. 1 is perspective view illustrating a first example of a trenching system include two side panel assemblies coupled by struts.
Figure 2:
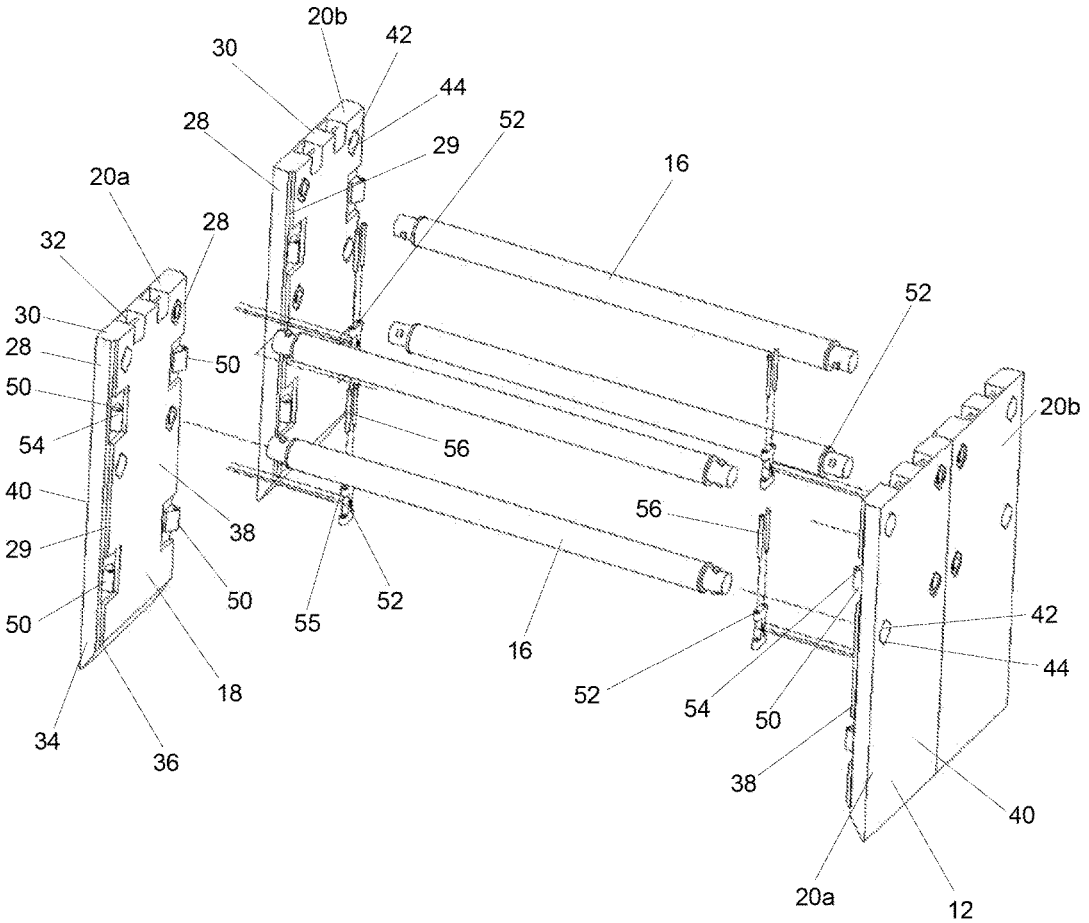
FIG. 2 is an exploded parts perspective view illustrating a first example of the trenching system.

Referring to FIGS. 1 to 3, there is shown an example of a trenching system 10 for shoring or supporting opposing walls of a trench (not shown). The trenching system 10 includes at least two side panel assemblies 12 adapted to be locatable in an installed condition with outer faces 14 thereof adjacent opposing walls of the trench with one or more removable struts 16 arranged to span between and support the inner faces 18 of the side panel assemblies 12.

Each of the at least two side panel assemblies 12 includes a plurality of removable and interchangeable panels 20 which in this example are provided in the form of a first panel 20*a* coupled to a second panel 20*b* in the installed condition by a releasable coupling arrangement 26. The releasable coupling arrangement 26 is arranged so as to be accessible from inner faces 14 of the at least two side panel assemblies 12 thereby allowing decoupling of the panel assembly to a disassembled condition from the installed condition from a position inside of the trench.

In more detail, and referring more specifically to FIG. 2, each of the plurality of panels 20 are generally rectangular in shape and includes relatively flat opposing sides 28 arranged to abut with opposing sides of adjacent panels 20, a top end 30 having lifting points 32 and a bottom end 34 including a tapered ground engaging tip 36. Each of the panels 20 includes an inner panel face 38 and an outer panel face 40. The inner panel face 38 faces inwardly of the trench and toward the inner panel faces 38 of the panels 20 on the opposing side of the trench, and the outer panel face 40 is arranged to be fitted against the trench wall. Each of the inner panel faces 38 and outer panel faces 40 are generally rectangular in plan form shape and are relatively flat.

The inner panel faces 38 each includes one or more strut coupling locations 42 provided in the form of an aperture or female socket 44 which receives and couple with the struts 16 in the installed condition. In some cases, all of the female sockets 44 are not use and blanks or plugs may be inserted into the female sockets 44 not in use.

The strut coupling locations 42 may be provided in the form of sockets extending from the inner panel face 38 or apertures recessed into the inner panel face 38 as is shown in this example. The strut coupling locations 42 and variations thereof are further described below with reference to FIGS. 8 and 9.

Each of the panels 20 includes a step or ledge 29 extending lengthwise along the corner of the panel 20 between the opposing sides 28 and the inner panel face 38. The step or ledge 29 is utilised to accommodate further parts of the system 10 such as corner posts that are further described below with reference to FIG. 10.

Figure 6A:
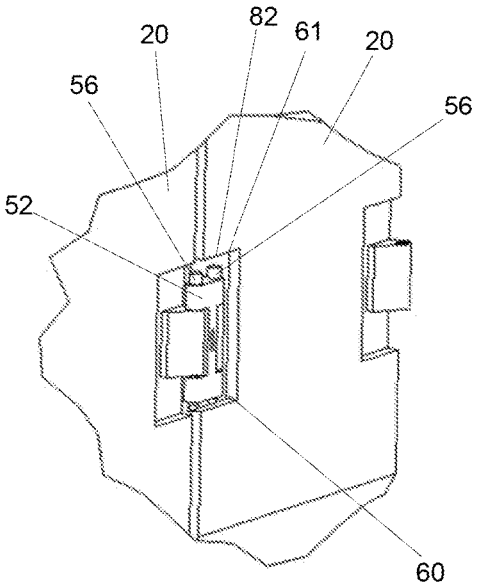
FIG. 6*a* is a perspective view illustrating a releasable coupling of the panels in a fitted or coupled condition between two panels.
Figure 6B:
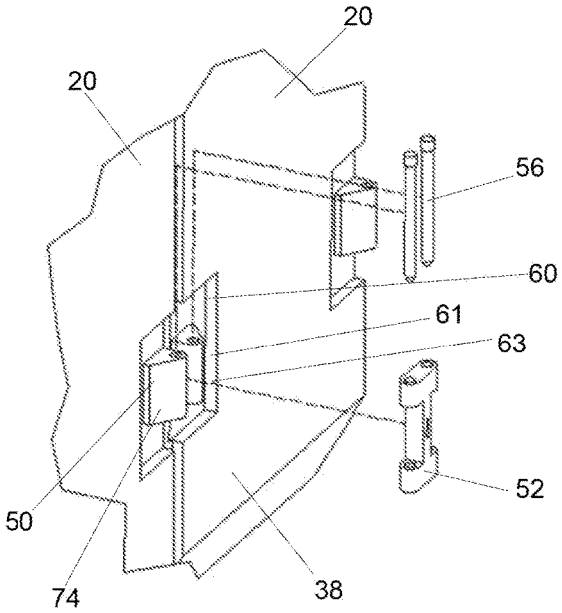
FIG. 6*b* is a perspective view illustrating the releasable coupling of the panels in a decoupled or removed condition.
Figure 7A:
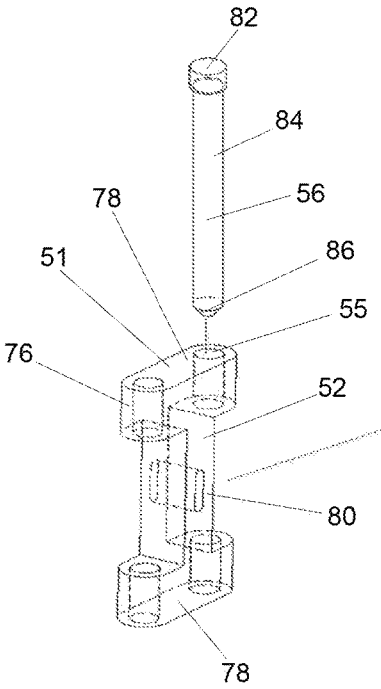
FIG. 7*a* is a perspective hidden detail view illustrating a removable coupling part and a pin.
Figure 7B:
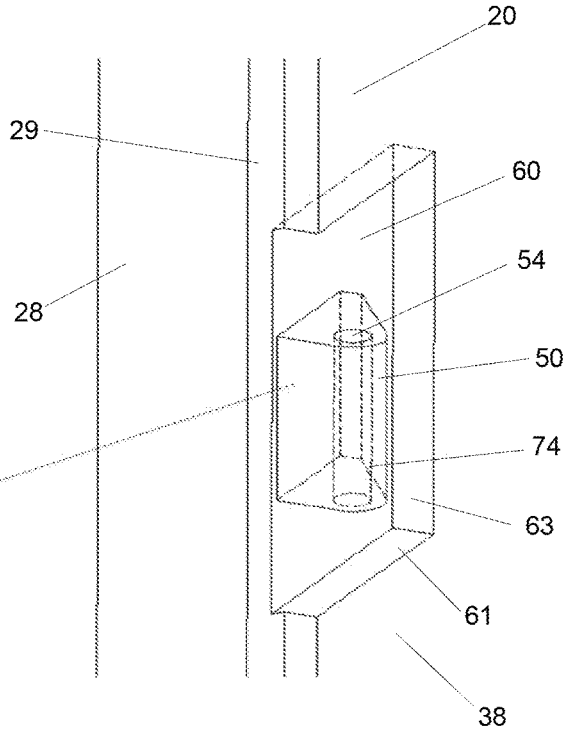
FIG. 7*b* is a perspective hidden detail view illustrating a fixed coupling part of the panel.

The releasable coupling arrangement 26 is arranged to allow hinging or pivoting movement of the first panel 20*a* relative to the second panel 20*b*. The releasable coupling arrangement 26 includes fixed coupling parts or coupling sections 50 carried by or formed within each of the first and second panels 20*a*, 20*b* and a removable coupling part 52 which hingedly interconnects the fixed coupling parts 50 and hence the first and second panels 20*a*, 20*b* in the installed condition. The fixed coupling parts 50 and removable coupling part 52 are described in more detail below with reference to FIGS. 6 and 7. It is noted that in some examples, the releasable coupling arrangement 26 may be a fixed coupling which is non-hinging or non-pivoting, in particular, in instances where the first panel 20*a* and the second panel 20*b* are arranged side-by-side and parallel with one another. An example of a non-pivoting releasable coupling arrangement 26 is shown, for example, in FIGS. 23*a* and 23*b*.

In this example, the panels 20 include four of the fixed couplings or coupling parts 50 with two of the fixed coupling parts 50 being located at to adjacent to each of the flat opposing sides 28 of the panels 20. The two fixed coupling parts 50 on each of opposing sides 28 are spaced apart from one another with one of the two fixed coupling parts 50 being located toward the top end 30 between the strut coupling locations 42, and the other of the two fixed coupling parts 50 being located toward the bottom end 34 of the respective panels 20.

Each of the fixed coupling parts 50 carried by each of the first and second panels 20*a*, 20*b* include a vertically arranged aperture 54 (shown best in FIG. 7*b*) into which a removable pin 56 is received in the coupled condition. The removable coupling part 52 also includes vertically arranged apertures 55 (shown best in FIG. 7*a*) which align in a fitted or coupled condition with the vertically arranged apertures 54 of the fixed coupling parts 50, and receive the pin 56 to coupled the removable coupling part 52 between the fixed coupling parts 50 carried by each of the first and second panels 20*a*, 20*b*.

Figure 3A:
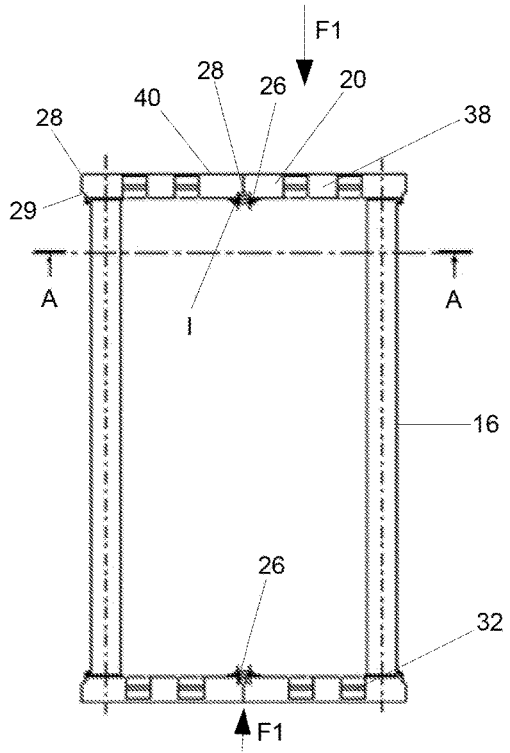
FIG. 3*a* is a top view illustrating the trenching system.
Figure 3B:
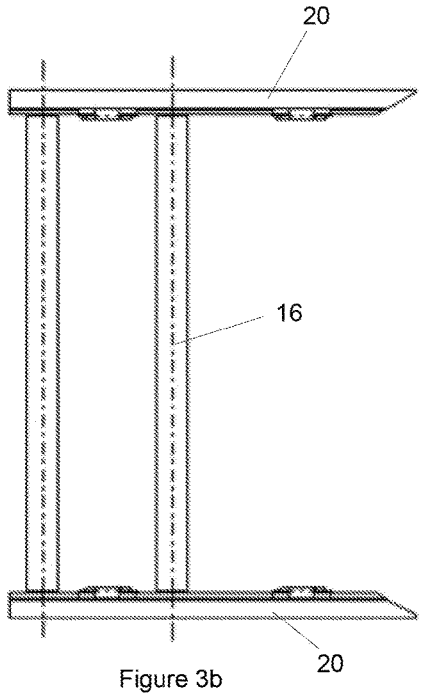
FIG. 3*b* is an end view illustrating the trenching system.
Figure 3C:
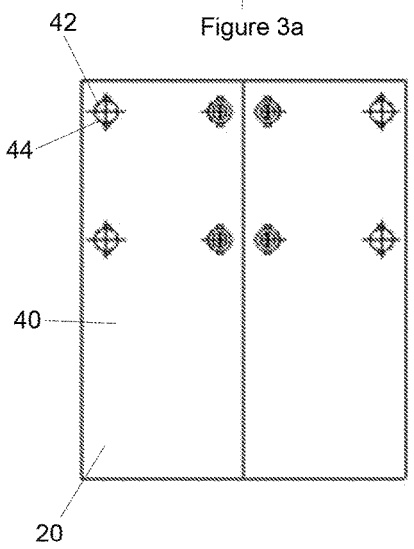
FIG. 3*c* in an outer side view of the trenching system.
Figure 3D:
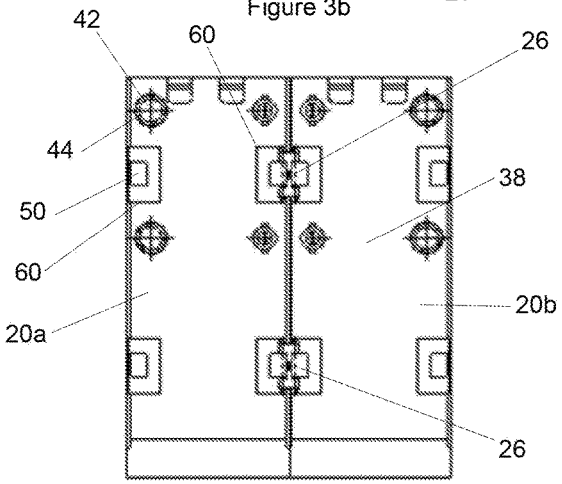
FIG. 3*d* is an inner side sectional view of the trenching system along section A-A as shown in FIG. 3*a;*

The vertical axis of the aperture 54 of the fixed coupling parts 50, as indicated by I in FIG. 3*a*, is inwardly spaced from the inner panel faces 38 and is also inwardly spaced from the opposing sides 28 of the panels 20. Accordingly, the releasable coupling arrangement 26 is a double hinge having two vertically aligned hinge points provided by the removable pins 56, the vertically arranged apertures 54 of the fixed coupling parts 50 and the vertically arranged apertures 55 of the removable coupling part 52.

The inner panel faces 38 of each of the first and second panels 20*a*, 20*b* includes a recess 60 in which the releasable coupling arrangement 26 is located. This allows the apertures 54 of the fixed coupling parts 50 to be accessible and aligned relatively close to the inner panel face 38 as well as being low profile to inhibit damage.

Figure 4:
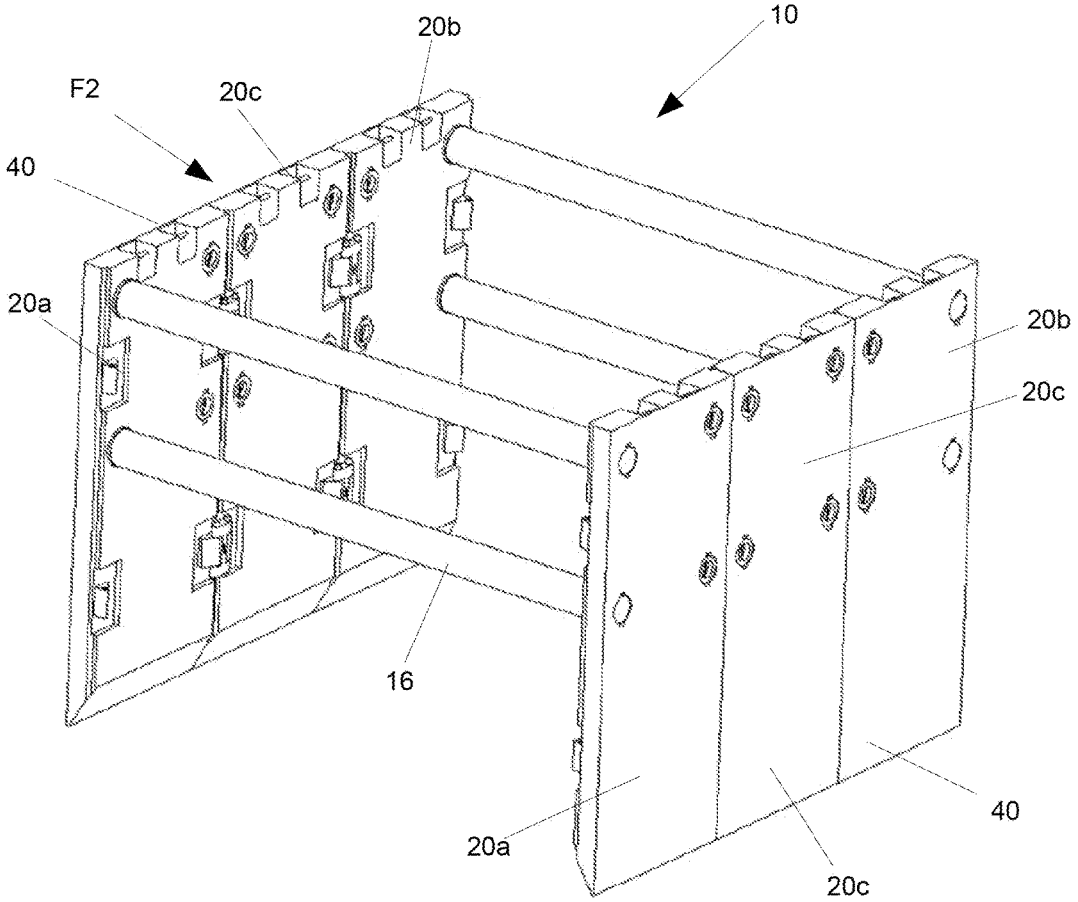
FIG. 4 is perspective view illustrating a second example of a trenching system include two side panel assemblies which each include three panels.
Figure 5A:
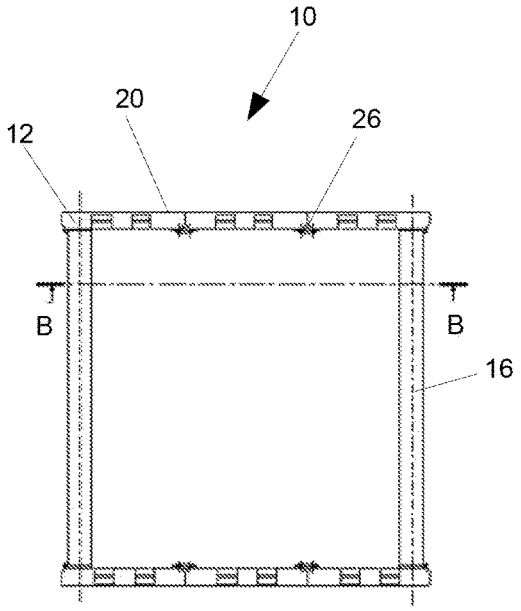
FIG. 5*a* is a top view illustrating the trenching system.
Figure 5B:
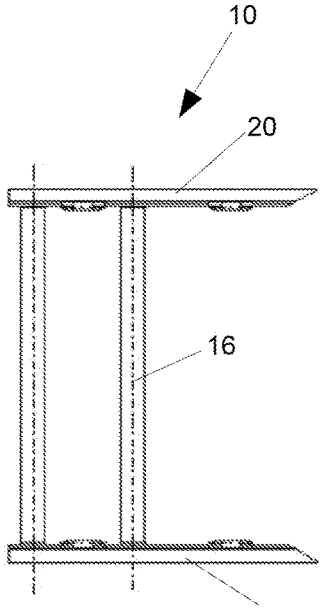
FIG. 5*b* is an end view illustrating the trenching system.
Figure 5C:
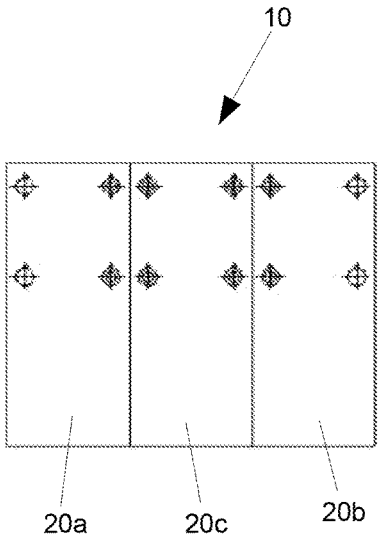
FIG. 5*c* in an outer side view of the trenching system.
Figure 5D:
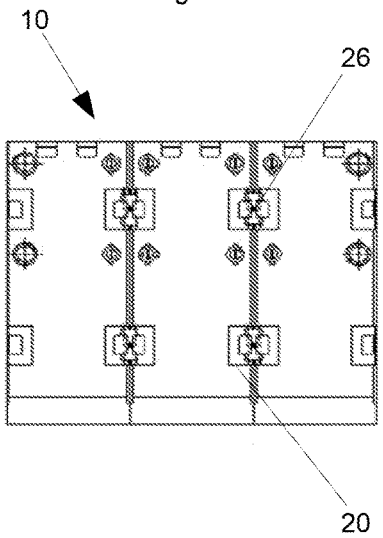
FIG. 5*d* is an inner side sectional view of the trenching system along section A-A as shown in FIG. 3*a;*
Figure 10:
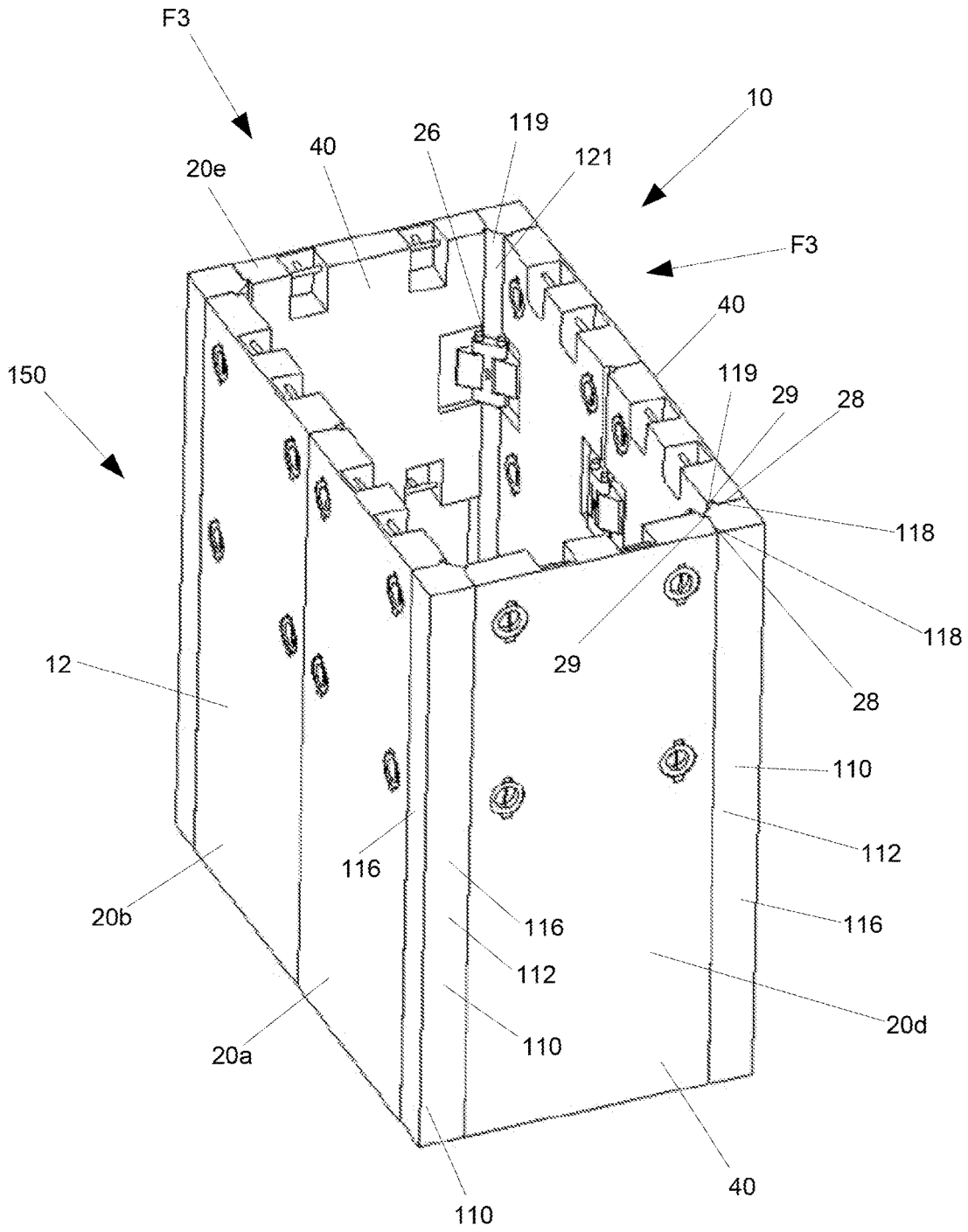
FIG. 10 is a perspective view illustrating a third example of the trenching system in which the panels are formed into a box or rectangular box and corner posts are fitted at the corners of the panels.
Figure 12:
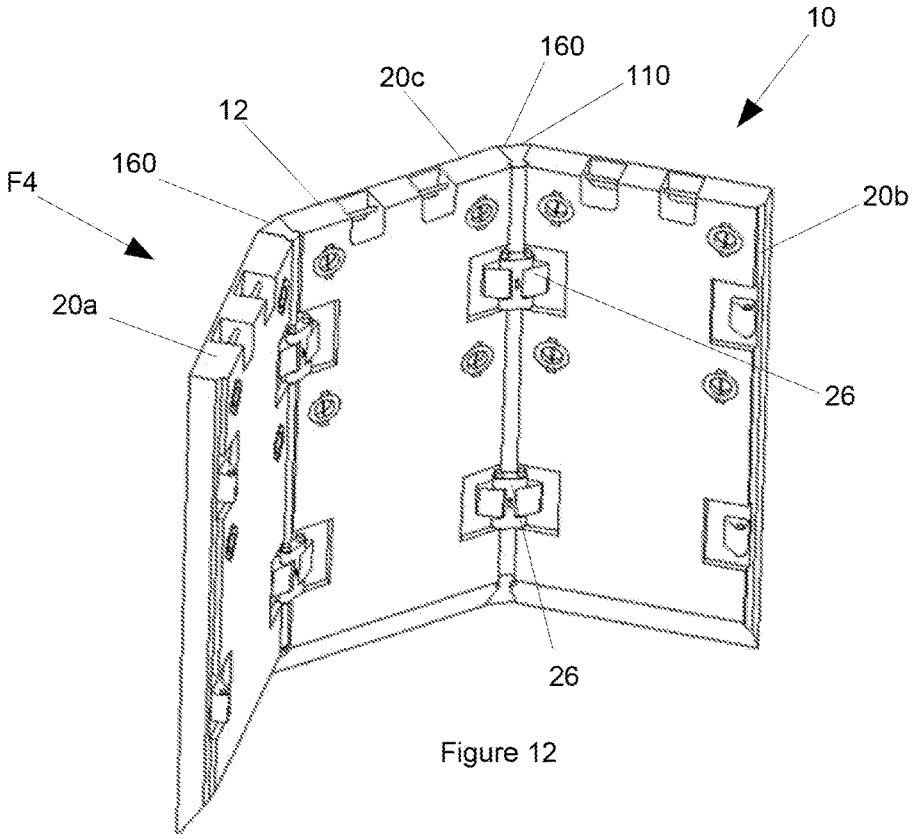
FIG. 12 is a perspective view a fourth example of the trenching system in which the panels are formed into a curve and wedges are fitted at the junctions between the panels.
Figure 14:
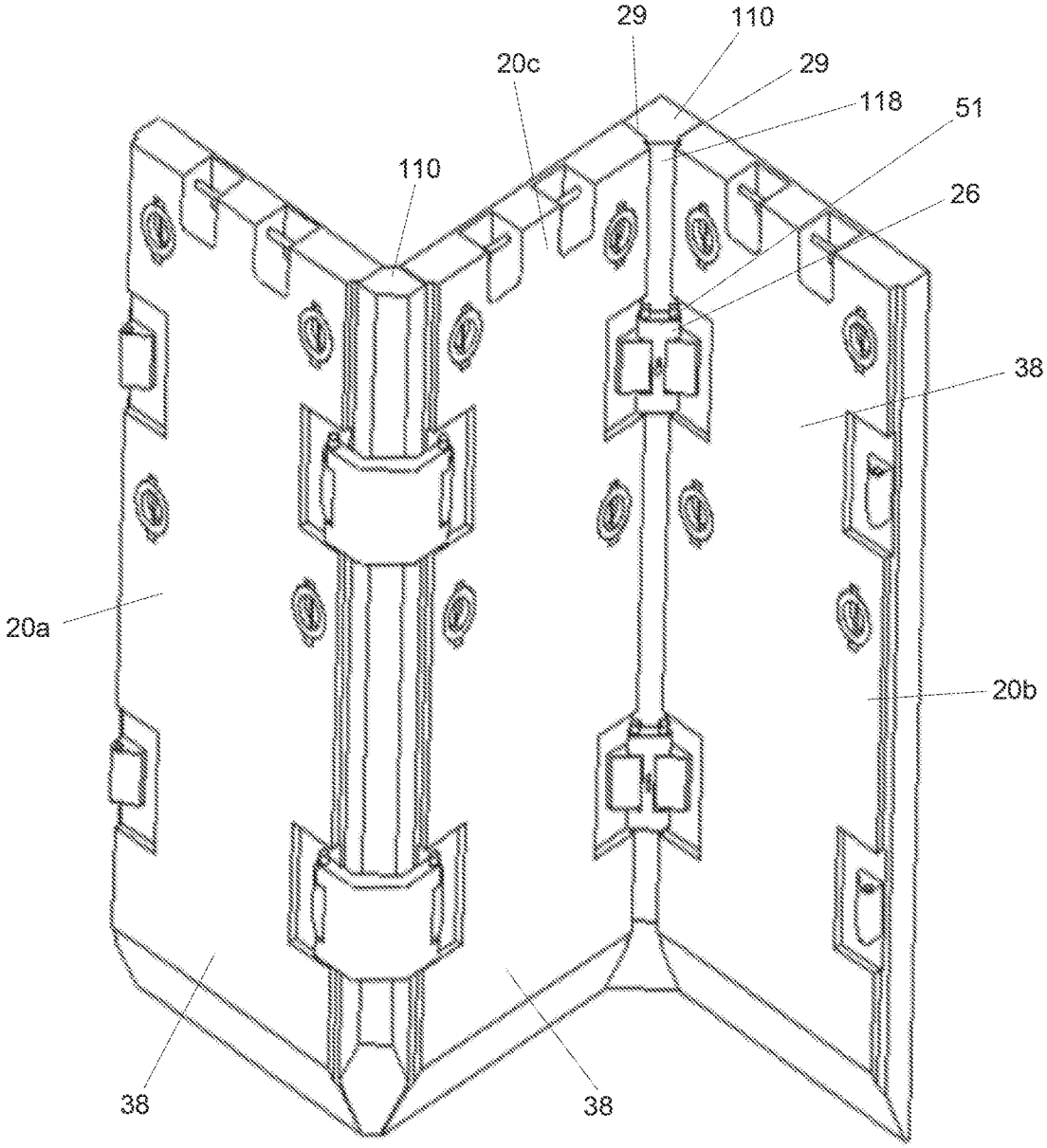
FIG. 14 is a perspective view a fifth example of the trenching system in which the panels are formed into a Z-shaped and corner posts are fitted at the junctions between the panels.

The releasable coupling arrangement 26 is configurable or changeable between a first configuration, such as that shown in FIG. 1 or FIG. 4, in which the panels 20 are at first installed angle, in this case 0 degrees, relative to one another, and a second configuration, such as that show in FIG. 10, 12 or 14, in which the first and second panels 20*a*, 20*b* are at a second installed angle relative to one another. In FIG. 10, the second installed angle is about 90 degrees and in FIG. 12 the second installed angle is about 45 degrees.

The releasable coupling arrangement 26 allows the panels 20*a*, 20*b* to be pivotally moved or hinged into place in a direction toward the trench wall. However, once the panels 20*a*, 20*b* are in the installed assembled condition, as shown in FIG. 1 with panels 20*a*, 20*b* adjacent one another, the panels 20*a*, 20*b* are inhibited from any further pivoting or hinging toward the trench wall by the releasable coupling arrangement 26, in particular, the removable coupling part 52, and the abutment of the opposing sides 28 of the panels 20*a*, 20*b*. The opposing sides 28 of the adjacent panels 20*a*, 20*b* are also abutted with one another so as to inhibit further rotation.

In use, when a load $F_1$ (as shown in FIG. 3*a*) is applied to the outer panel faces 38 the struts 16 become under compression and the junction or joint between the panels 20*a*, 20*b* will also be urged inwardly. This places the releasable coupling arrangement 26 under tension, in particular, the removable coupling part 52 under tension, to maintain the panels 20*a*, 20*b* in a generally aligned and parallel arrangement without significant bowing. The opposing faces 28 are placed into compression. The more specific features and operation of the releasable coupling arrangement 26 are further described below with reference to FIGS. 6 and 7.

The panels 20 and components of the releasable coupling arrangement 26 thereof may preferable be formed from a metallic material such as mild-steel or aluminium. The strut 16 may also be formed from a suitable metallic material. Other materials are also considered such as metal composite panels or high strength plastics. The length of the panels 20 is about 2.5 m and the width is about 1 m. However, other sizes of panels may also be utilised.

Referring now to FIGS. 4 and 5, there is shown a second example of the trenching system 10 in which a further panel 20, in this example indicated as a central panel 20*c*, has been fitted between the first and second panels 20*a*, 20*b* of as shown in the first example in FIG. 1. Whilst one a single additional central or further panel 20*c* is shown, any number of additional central or further panels 20*c* may be added to extend the trenching system 10 lengthwise along the trench. In this example, the central or further panel 20*c* is identical to the first and second panels 20*a*, 20*b* of the first example and is not again described here and like numerals are used to denote like parts. However, it is noted that the central or further panels 20*c* may be provided without the one or more strut coupling locations 42.

In this example, the central panel 20*c* is coupled via releasable coupling arrangement 26 on each of its opposing sides 28. Accordingly, in use, when a load or force $F_2$ is applied to the outer panel faces 38 of the central panel 20*c* the releasable couplings 26 are placed under tension to keep the panels 20 including the central panel 20*c* and the flanking first and second side or outer panels 20*a*, 20*b* in a relatively straight line so as to maintain and support the walls of the trench. During the applied of this force, each of the opposing sides 28 between the panels 20*a*, 20*b* and 20*c* are placed into compression.

In either of the first and second examples provided above, the trenching system 10 may be assembled in a variety of ways including: assembling out of the trench and then lowering into the trench as a single unit; assembling the two side panel assemblies 12 out of the trench and the lowering the two side panel assemblies 12, in this example, including the central panel 20*c* between the first and second end panels 20*a*, 20*b*, and then coupling the struts 16 between the two side panel assemblies 12 within the trench; and the lowering the individual panels 20 and struts 16 into the trench and assembling the trenching system 10 in-situ. Other examples of use could also include fitting additional central panels 20*c* in-situ to increase the length of the trenching system 10.

Referring now to FIGS. 6*a*, 6*b*, 7*a* and 7*b*, the releasable coupling arrangement 26 is shown in further detail. Each of the fixed couplings 50 include a wedge shaped body 74 tapering away from the outer panel faces 38 and the aperture 54 extends lengthwise through the wedge shaped body 74.

In this example, the removable coupling 52 is provided in the form of an I-shaped coupling part 51 that includes an I-shaped (also known as dog-bone) shaped body 76 arranged to span between and couple the fixed couplings 50. However, it is noted that other shaped coupling could also be used such as double forked (3 prongs each side), or belt buckle style with backed edge bearing (under load) on outside edge of attaching cleat.

The I-shaped body 76 includes ends 78 which each include two apertures 55 arranged to align with the apertures 54, and a neck 80 which extends between the ends 78. The neck 80 is recessed relative to the ends 78 and is shaped to fit with and receive part of the corresponding wedged shaped bodies 74 of the fixed couplings 50 in the fitted condition. The pins 56 may then the inserted though the aligned apertures 54, 55. The recess 60 includes walls 61 which are sized to accommodate the I-shaped body 76 in the fitted condition and to provide clearance for a user to hand or manually insert and remove the pins 56. The wall 61 provides a ledge or step 63 between the surface 65 of the recess 60 and the inner panel face 38.

The pins 56 include a head 82, a shank 84 and a tip 86. The aligned apertures 54, 55 and head 82 of the pin 56 are arranged such that when the pins 56 are in the fitted condition, as shown for example in FIG. 6*a*, the walls 61 of the recess 60 partially capture the heads 82 of pins 56. This assists to retain the pins 56 as part of the coupling 26 whilst in use. More specifically, the pin head 82 has a diameter that prevents the pin 56 from passage through the apertures 54, 55, but clears the main inside face 38 of the panels 20 so as to be insertable and removable.

Figure 8:
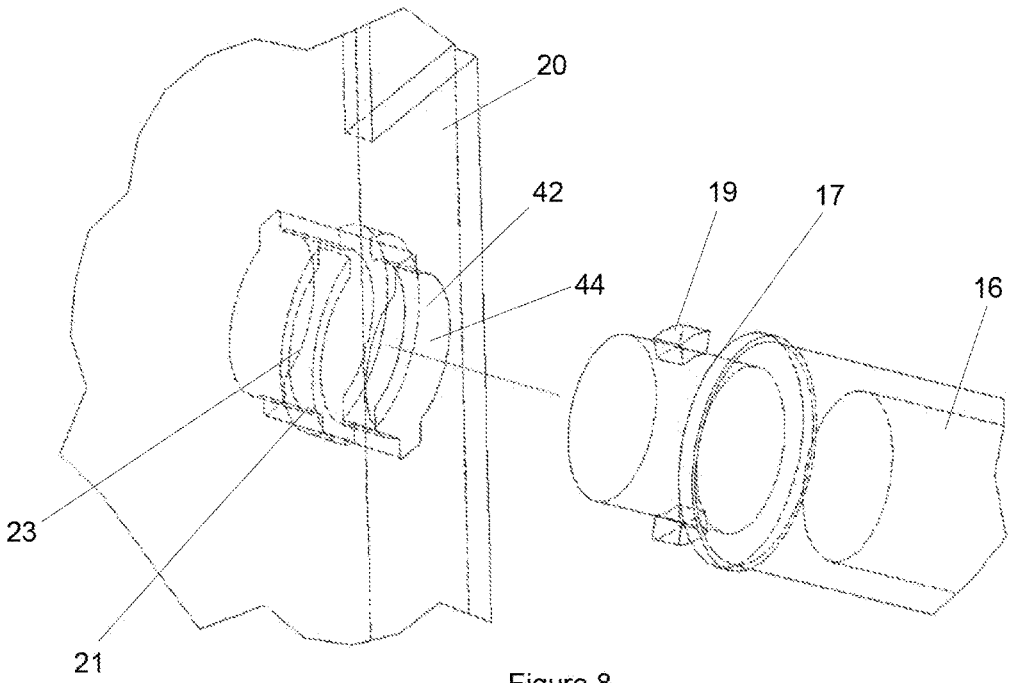
FIG. 8 is a perspective hidden detail view illustrating a coupling between the strut and the panel.

Referring now to FIG. 8, the strut coupling portions 42 between the strut 16 and the panel 20 is shown in more detail. The strut 16 includes spigots 17 which carry keys 19, and the aperture 44 of the strut coupling portions 42 include a keyway 21 provided in the form of radial channels 23 which are arranged to receive and twist-lock with the keys 19 of the spigots 17. Accordingly, the struts 16 may be hand fitted and secured between any opposing set of panels 20 either in-situ or prior to the panels 20 or an assembly of the panels 20 being lowered into the trench.

Figure 9:
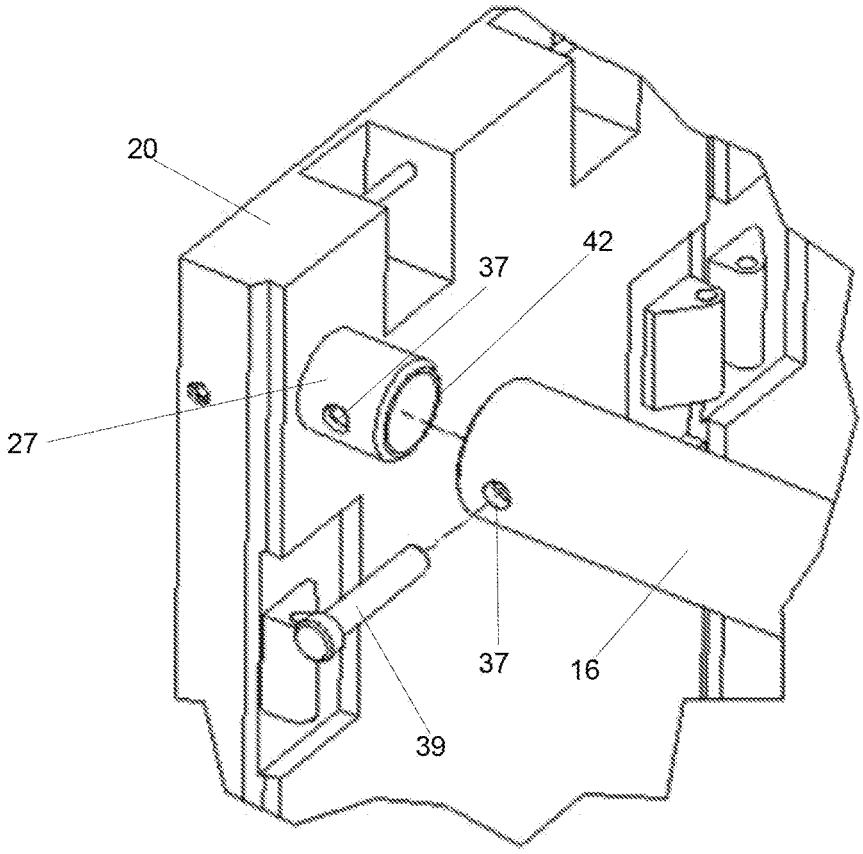
FIG. 9 is a perspective view illustrating another example of a coupling between the strut and the panel.

Referring now to FIG. 9, in other examples the strut coupling portions 42 of the panels 20 may be provided in the form of spigots 27 carried by and extending from the panels 20 and dimensioned to be received by hollow ends 25 of the struts 16. The ends 25 of struts 16 and the spigots 17 include corresponding apertures 37 which are coupled by a pin 39.

Figure 11A:
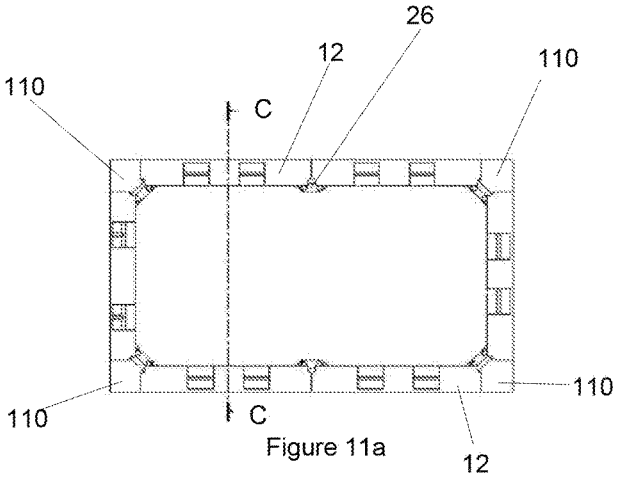
FIG. 11*a* is a top view illustrating the trenching system shown in FIG. 10.
Figure 11B:
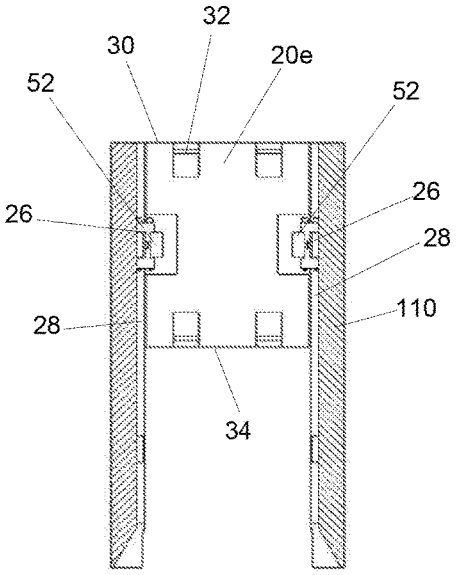
FIG. 11*b* is an end sectional view illustrating the trenching system along section C-C as shown in FIG. 11*a;*
Figure 11C:
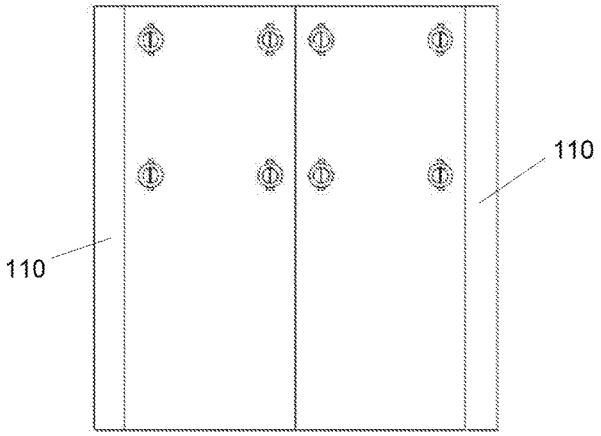
FIG. 11*c* in an outer side view of the trenching system.

Referring now to FIGS. 10 and 11, the trenching system 10 is shown in another or third configuration and like numerals are used to denote like parts. In this example, the panels 20 are formed into a box or rectangular box like structure 150 having corner posts 110 located at each of the corners. Each of the opposing sides includes two panels 20*a* and 20*b*, or panel assemblies 12, and each of the ends includes a single panel 20*d*. The couplings 26 are similar to those described in relation to FIGS. 1, 6 and 7 and allow the end panels 20*d* to be pivoted to the second configuration which in this example has the end panels 20*d* perpendicular or at 90 degrees to the panel assemblies 12.

The corner post 110 is provided in the form of an outward or trench wall facing corner post 112 (as opposed to an inward facing corner post as is further described below with reference to FIG. 14). The outward facing corner post 112 includes two generally flat and perpendicular sides 116, which face the trench walls, and two abutting sides 118 which abut with the opposing sides 28 of the panels 20 in use. The two abutting sides 118 meet at a retaining portion 118 extending lengthwise between the two abutting sides 118. The retaining portion 119 is shaped to be captured and retained by the ledges 29 of the adjacent panels 20. The outward facing corner post 112 is dimensioned such that two generally flat sides 116 fit substantially flush with the outer panel faces 40 of the adjacent panels 20.

The retaining portion 119 include an inward face 121 which is angled at about 45 degrees relative to the inner panel faces 40 of the adjacent panels 20. The coupling 26, in particular the removable coupling part 52, is arranged to being correspondingly located at about 45 degrees relative to the adjacent panels 20 and is snuggly captured between the fixed coupling parts 52 and the inward face 121 which supports the removable coupling part 52. Accordingly, in this arrangement, when an external force $F_3$ is applied, the removable coupling part 52 between the perpendicular panels 20 is placed into compression and the retaining portion 119 also serves to retain the ledges 29 of the perpendicular panels 20 thereby ensuring the structural integrity of the arrangement of panels 20. The two side-by-side panels 20*a* and 20*b* are coupled and function in a similar way to that described in relation to FIG. 1 and are not again described here.

In this example, one of the end panels 20*d* is shown as a short panel 20*e* (shown best in FIG. 11*b*) which is configured generally as the upper half of one of the longer panels 20. It is noted that the bottom 34 of the short panel 20*e* includes lifting points 32 and is symmetrical between its top 30 and bottom 34. The short panel 20*e*, however, only include a singe fixed coupling 52 on each of its opposing sides 28.

Figure 13:
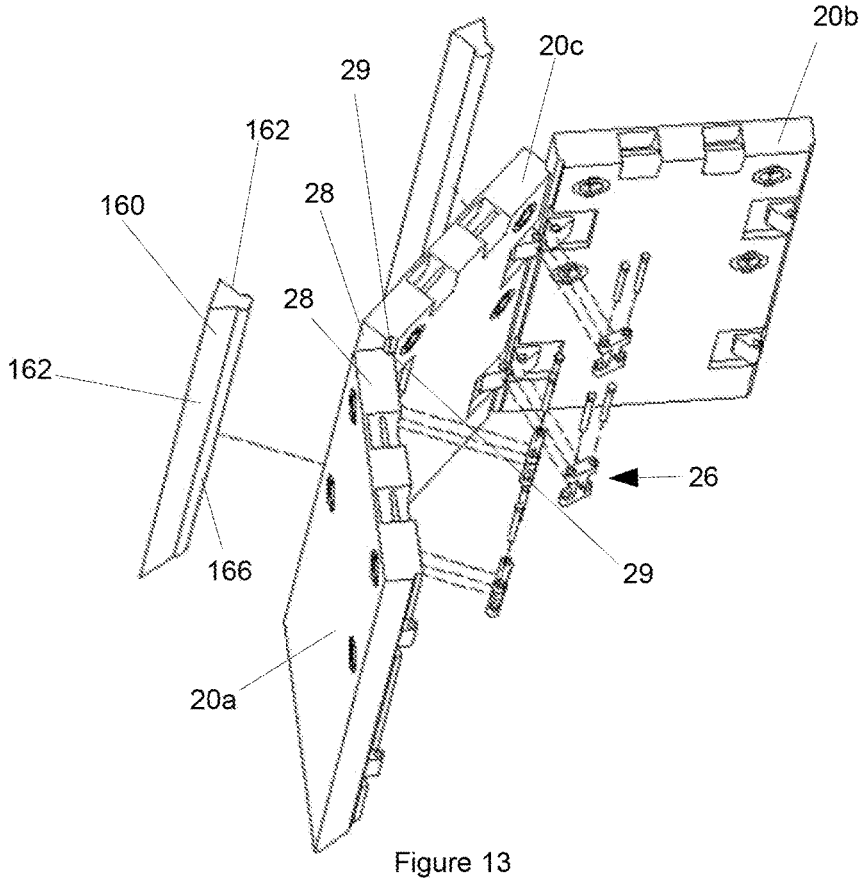
FIG. 13 is an exploded parts perspective view of the trenching system as shown in FIG. 12.

Referring to FIGS. 12 and 13, the trenching system 10 is shown in a another or further configuration in which the panel assembly 12 may be formed as a curved panel arrangement in which are series of posts 110 in the forms of elongate wedges 160 are placed between the opposing sides 28 of adjacent panels 20. In this example, the wedges 160 are arranged to provide an angle of about 45 degrees between the adjacent panels 20. However, the wedges 160 may be configured for any angle up to about 90 degrees in which case the wedges 160 become outer corner posts 112 as are described above in relation to FIG. 10.

The wedges 160 include tapered sides 162 which are arranged to taper from an outward face 164 to an inward retaining portion 166 which is captured and retained by the ledges 29 of the opposing side walls 28 of the adjacent panels 20. The coupling part 52 in the form of the I-shaped coupling 51 is used to interconnect the fixed coupling parts 52 of the adjacent panels 20 in a similar manner as described above in relation to FIGS. 6 and 7, and the coupling part 52 is placed into compression when a force $F_4$ is applied to, for example panel 20*a*, with the coupling part 52 being supported by the inward retaining portion 166 and between the fixed coupling parts 50 in a similar manner to that described above in relation to FIG. 10.

Figure 15:
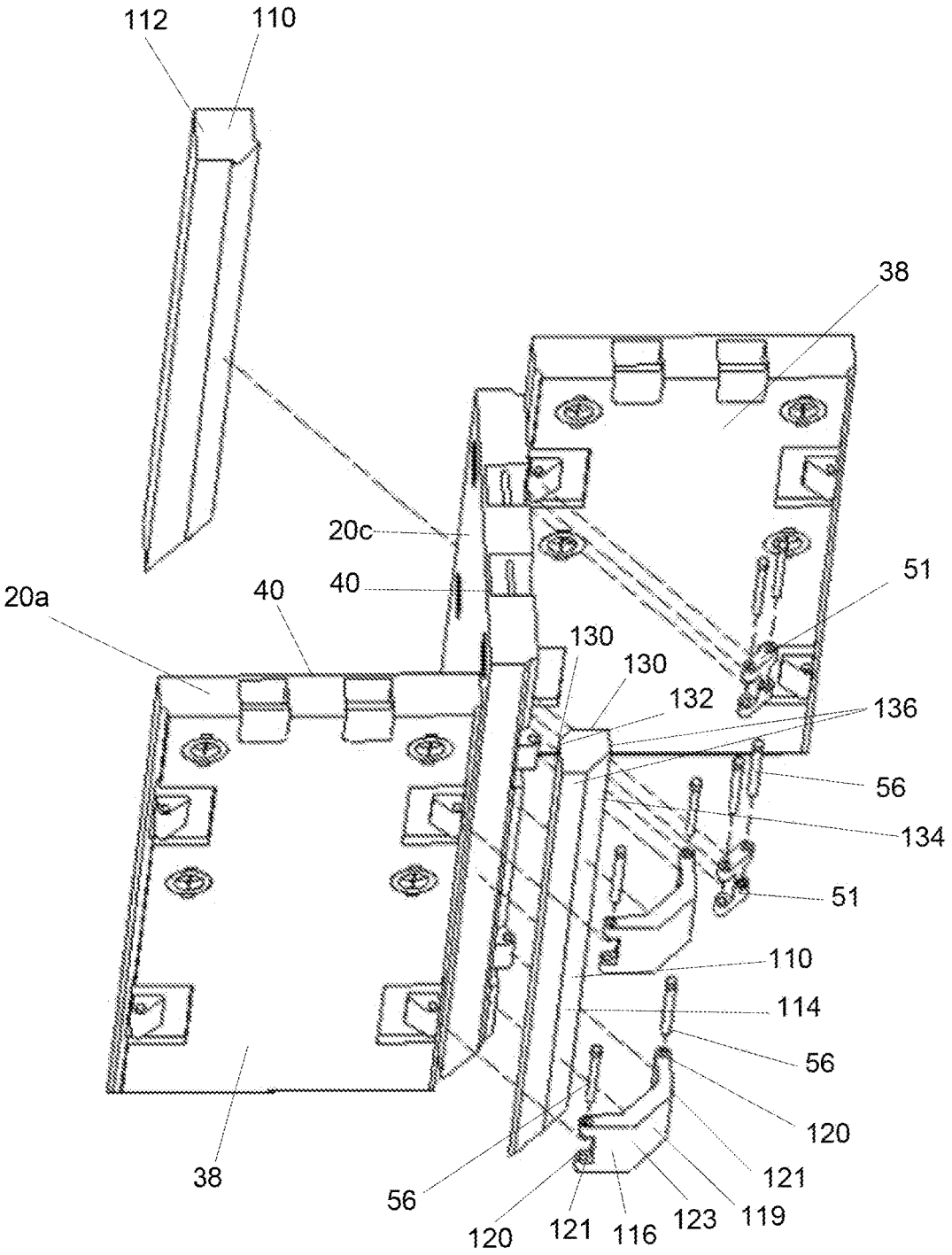
FIG. 15 is an exploded parts perspective view of the trenching system as shown in FIG. 14.

Referring now to FIGS. 14 and 15, the trenching system 10 is shown in yet another or fifth configuration and like numerals are used to denote like parts. In this configuration, the first and second panels 20*a*, 20*b* are each perpendicular to the central panel 20*c* and corner posts 110 are fitted between the central panel 20*c* and each of the first and second panels 20*a*, 20*b*. The trenching system 10 may be considered to be in a Z-shaped configuration.

In this example, two different type of corner posts 110 are provided, the first type being the wall or outward facing corner post 112 (as shown in FIG. 10 above) and the second type being an inward facing corner post 114.

The releasable coupling arrangement 26, more specifically the I-shaped coupling part 51, allows the inward hinging of the panels 20, in this example the pivoting of the inner panels faces 38 of the central panel 20*c* and the second panel 20*b* toward one another to a perpendicular angle or about 90 degrees (as is shown in FIG. 10 above). Accordingly, similarly to that described in relation to FIG. 10, the retaining portions 118 of the outward facing corner posts 112 are shaped to be captured and retained by the ledges 29 of the adjacent panels 20*b* and 20*c*. The outward facing corner post 112 is dimensioned such that two generally flat sides 116 fit substantially flush with the outer panel faces 40 of the central panel 20*c* and the second panel 20*b*.

However, as the I-shaped coupling part 51 does not allow for hinging of the outwardly or in a direction bringing the outward panel faces 40 together, a longer coupling part 116 is required to coupled between the fixed couplings 50 of the central panel 20*c* and the first panel 20*a*. The longer coupling part 116 includes a part C-shaped body 119 arranged to fit with and capture the inward facing corner post 114 and apertures 120 at opposing ends 122 of the body 119 arrange to receive the pins 56 and interconnect the longer coupling part 116 with the fixed coupling parts 50. The body 119 includes free end portions 121 which are angled at about 45 degrees to a central portion 123.

The inward facing corner post 114 includes abutting sides 130 arranged to abut with the opposing sides of the first panel 20*a* and the central panel 20*c*. The abutting sides 130 fan outwardly from an inner face 132, which faces the corner, to an outer face 134 which faces away from the corner and abuts with the longer coupling part 116. The outer face 134 is angled at about 45 degrees to the abutting sides 130 and opposing sides 136 of the outer face 134 are chamfered at about 45 degrees to the outer face 134. The chamfered opposing sides 136 of the outer face 134, when fitted as shown in FIG. 14, are parallel and flush with the inner panel faces 38 of the central panel 20*c* and the first panel 20*a*.

Figure 16:
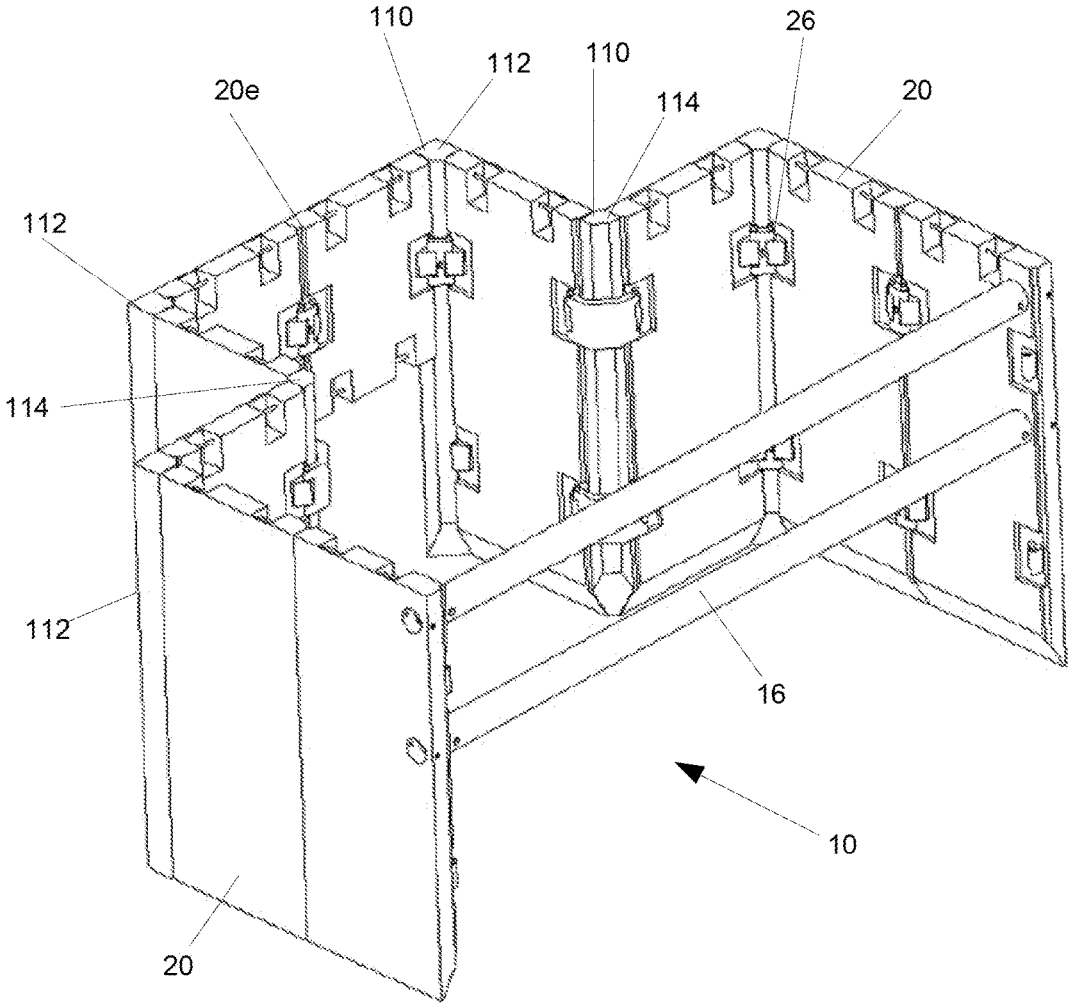
FIG. 16 is a perspective view a sixth example of the trenching system in which the panels are formed into a further shape with corner posts fitted at the junctions between the panels and braces supporting the free ends of the panels.
Figure 17A:
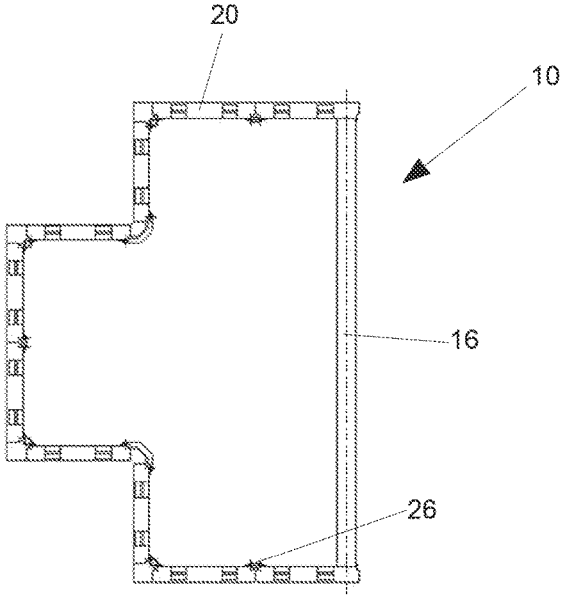
FIG. 17*a* is a top view of illustrating the trenching system as shown in FIG. 16.
Figure 17B:
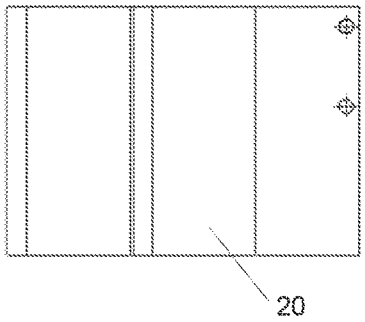
FIG. 17*b* is a outside view of illustrating the trenching system as shown in FIG. 16.
Figure 17C:
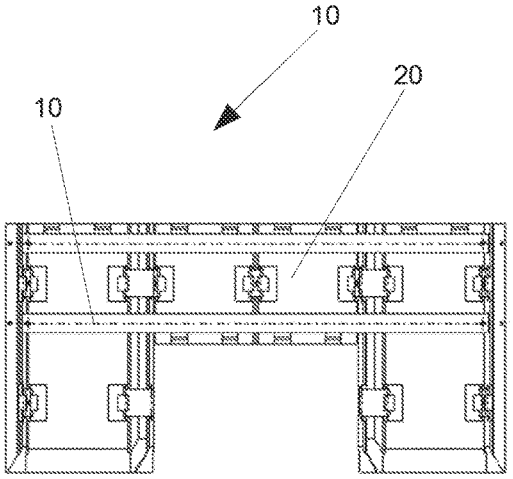
FIG. 17*c* is an inside view of illustrating the trenching system as shown in FIG. 16.

Referring now to FIGS. 16 and 17, the trenching system 10 may be configured in a wide range of arrangements which include straight sections or panel assemblies and corner or perpendicular sections formed using the corner posts. The braces 16 may also be placed between the panels 20 for support. Such configurations may use a selection of the couplings 26 and corner posts as has been described above. This example demonstrates the flexibility of the trenching system 10 to be arranged to support trenches of differing sizes and shapes.

Figure 18:
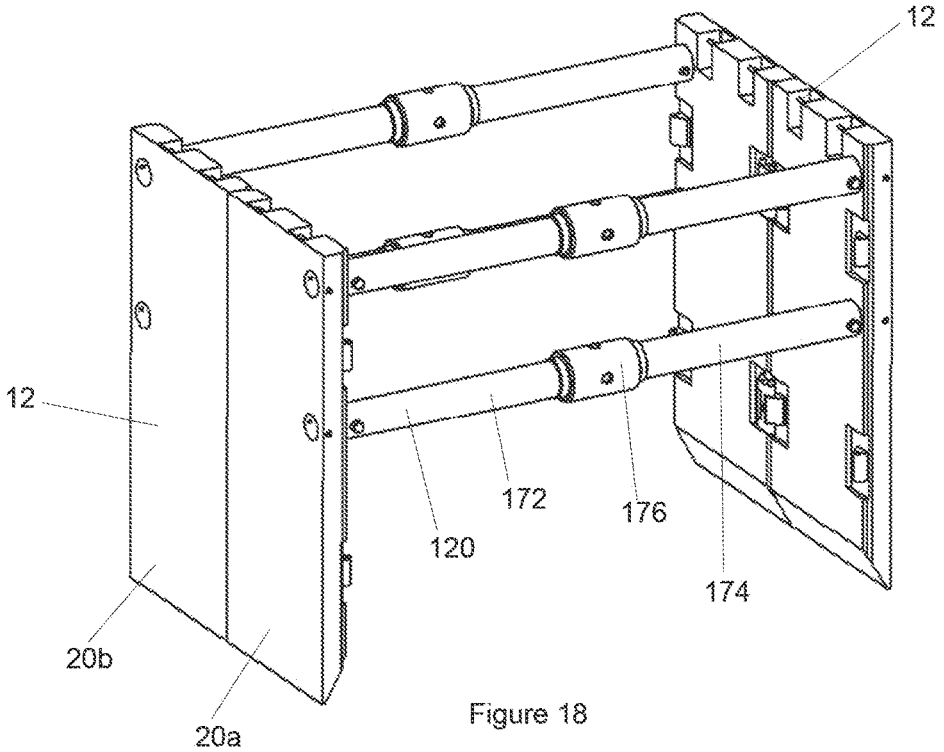
FIG. 18 is a perspective view of a seventh example of the trenching system having adjustable struts between the panel assemblies.

Referring to FIG. 18, the struts 16 may be provided in the form of adjustable struts 120 having two parts 172 and 174 which are coupled together by a rotatable threaded coupling 176. The rotatable threaded coupling 176 may be rotated by a tool to extend and retract the adjustable struts 120. The opposing threads are opposite hand so strut extends (or retracts) to lengthen or shorten strut, other options such as the use of hydraulic or pneumatic cylinder could be employed to achieve the same effect.

Figure 19:
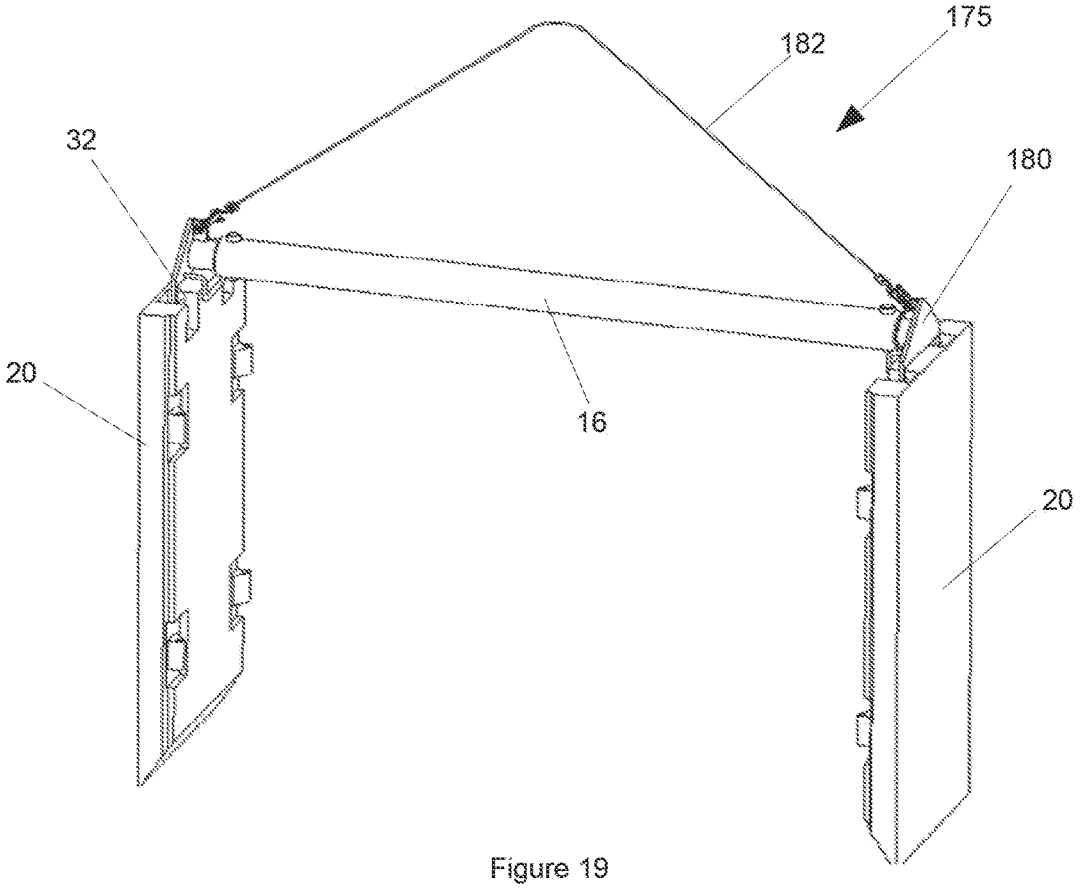
FIG. 19 is a perspective view of an eighth example of the trenching system having a lifting arrangement coupled between panels for lifting the panels.
Figure 20:
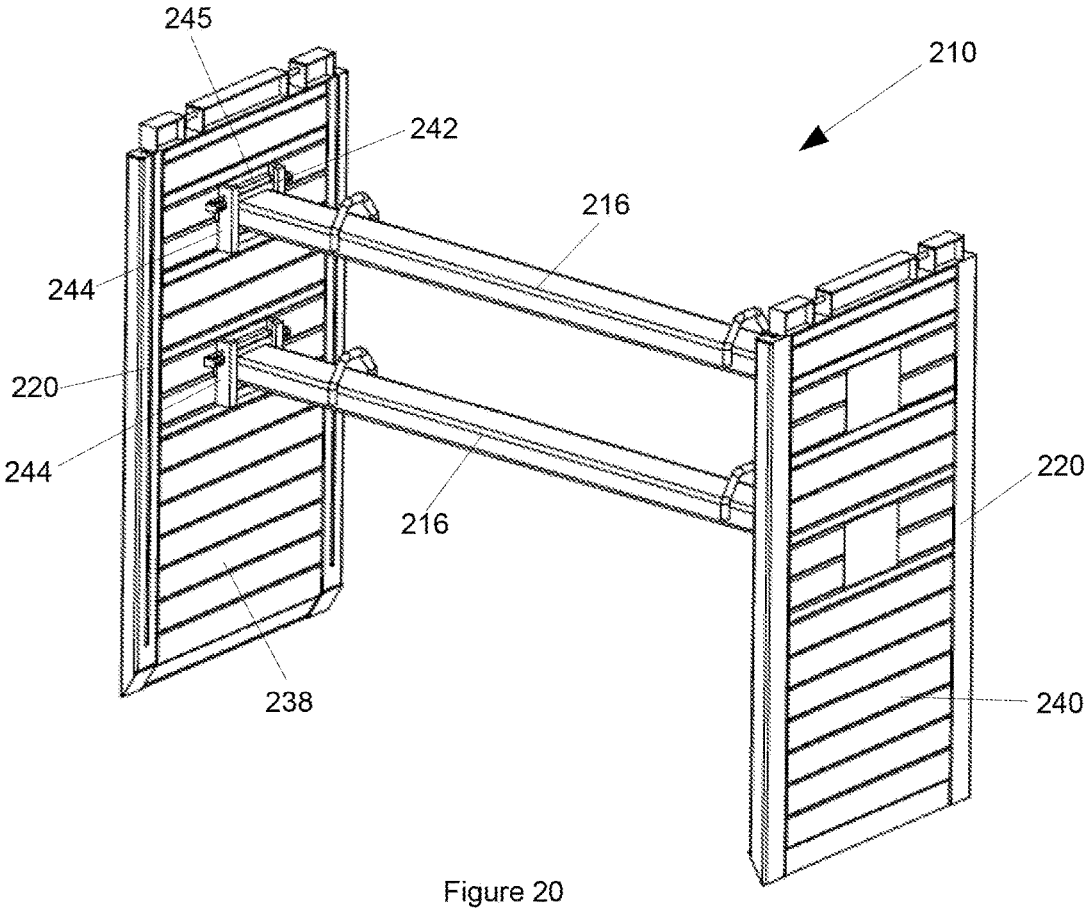
FIG. 20 is perspective view illustrating a ninth example of a trenching system including two opposing panels coupled by removable struts.
Figure 21:
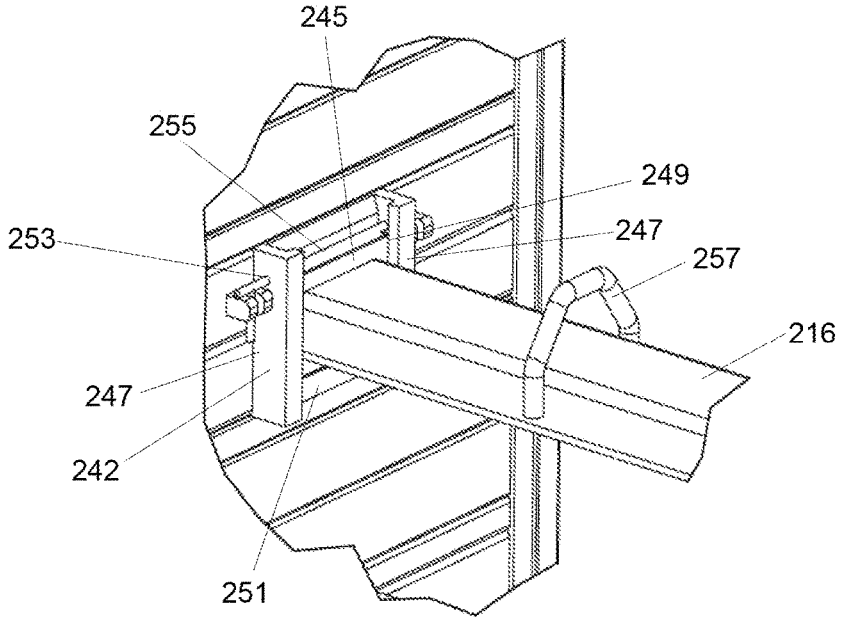
FIG. 21 is a detailed perspective view illustrating the coupling of one of the struts to one of the panels shown in FIG. 20.
Figure 22B:
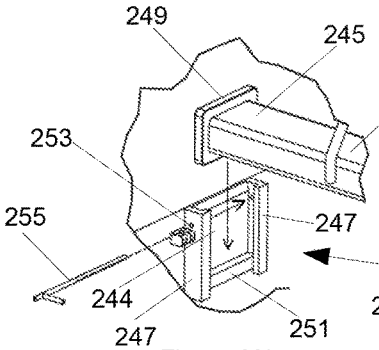
FIG. 22*b* is a detailed perspective view illustrating the coupling between one of the struts and panels as shown in FIG. 22*a;*
Figure 22A:
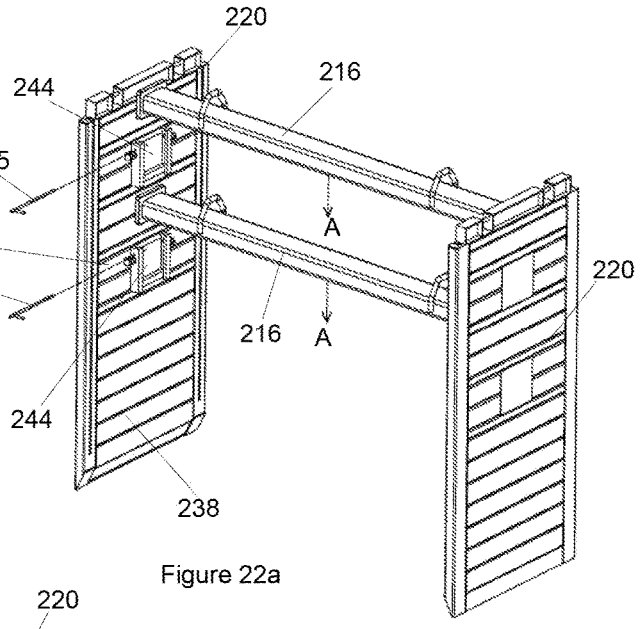
FIG. 22*a* is a perspective view illustrating the trenching system include two opposing panels coupled by the struts with locking pins removed.

Referring to FIG. 19 there is shown a lifting arrangement 175 including the strut 16 coupled between two lifting brackets 180 at opposing ends of the strut 16. Each of the lifting brackets 180 is coupled to opposing ends of a lifting element 182 (that may be provided in the formed of a wire, rigging or chains) that spans between the lifting brackets 180. The lifting brackets 180 are each coupled between the lifting points 32 located toward the tops 30 of the panels 30. The lifting element 182 may be coupled to a hoist or crane to lift the panels 20 via the lifting points 32.

Referring now to FIGS. 20 to 29 there is shown a further example of a trenching system 210 for shoring or supporting opposing walls of a trench (not shown). In this example, the overall function of the trenching system 210 is similar to the first example described above and like sequences of numerals i.e. 10, 210 are used to denote like or similar parts. Accordingly, all parts and functionality are not again described here. Rather, the description here will focus on the alternative means of coupling the panels 220 together including side-by-side coupling of adjacent panels and the coupling of panels 220 on opposing sides of the trench with the one or more removable struts 216.

Referring to FIGS. 20 to 22*b* and turning firstly to the coupling of the struts 216, in this example, the one or more strut coupling locations 242 are provided in the form of an aperture or female socket 244 that is arranged to receive corresponding male ends 245 of removable struts 216. More specifically, in this example, the socket 244 is arranged to slidably receive the male ends 245 in a vertical direction, indicated by Arrow "A" in FIG. 22*a*, generally aligned with the same plane as the inner panel face 238, and restrict movement in both a lateral direction between the panels and in a direction across the trench. Each of the panels 220 includes two female sockets 244 that are positioned one-above-the-other such that when assembled two struts 216 span between the panels 220 likewise one-above-the-other.

The socket 244 includes opposing lateral channels 247 that stand proud of the inner panel face 238 and the male ends 245 of the struts 216 include flanges 249 that are slidably received between the channels 247. The male and female arrangement could, of course, be reversed with the struts 216 having the female socket and the panels have a male flange or the like.

The opposing lateral channels 247 are blinded by a ledge 251 on which the male ends 245 are seated in the installed or fitted condition, and the opposing lateral channels 247 include aperture 253 through which a locking pin 255 is fitted to secure the removable struts 216 to the panels 220. In this example, the removable struts 216 also include handles or lifting points 257 arranged to allow the lifting of the removable struts 216, and also the assembled panel assemblies 212 when secured together by the removable struts 216.

Referring now to FIGS. 23*a*, 23*b*, 24*a* and 24*b*, in this example, the releasable coupling arrangement 226 includes a fixed coupling or coupling section 250 that is provided in the form of channels or slots 221 extending along and within the inner panel faces 238 toward or adjacent to the opposing sides 228, and the removable coupling part or section 252 is provided in the form of an elongate member 227 adapted to fit with and span between the slots 221 of adjacently arranged panels 220.

The elongate member 227 includes a supporting elongate body 229 and two-spaced apart coupling projections 231 extending from the elongate body 229. In this example, the two-spaced apart coupling projections 331 are provided in the form of two-spaced apart "T-shaped" flanges 333 that extend along the length of the supporting elongate body 229. The two-spaced apart coupling projections 331 are spacing inwardly from each of the opposing sides 235 of the supporting elongate body 229.

Figure 23B:
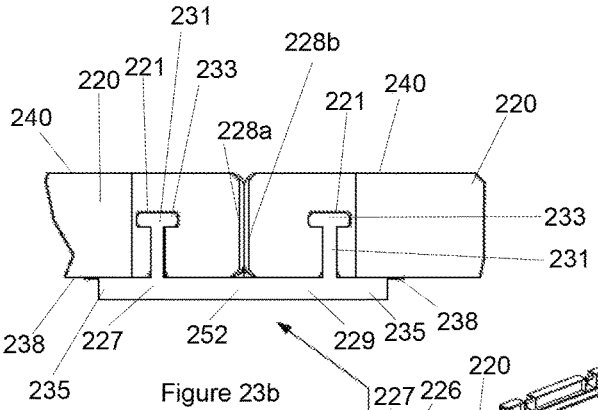
FIG. 23*b* is a top view illustrating a coupling member fitted between two adjacent panels as shown in FIG. 23*a;*
Figure 23A:
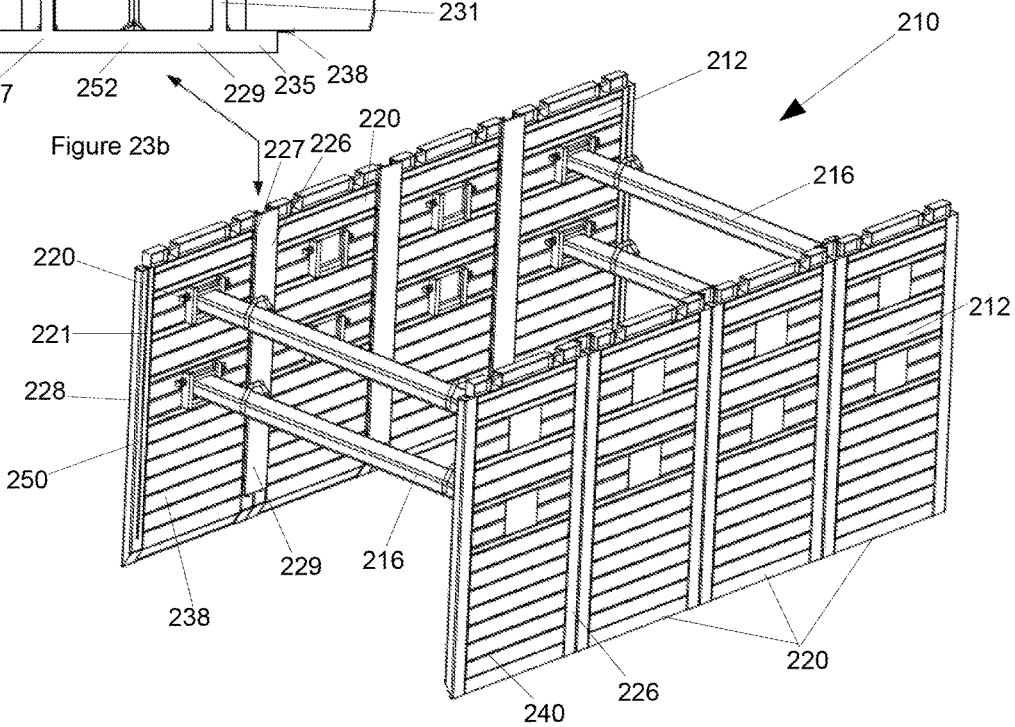
FIG. 23*a* is a perspective view illustrating the trenching system having two side panel assemblies coupled by struts where further panels are inserted between the end panels to extend the length of the panel assemblies.
Figures 24A, 24B:
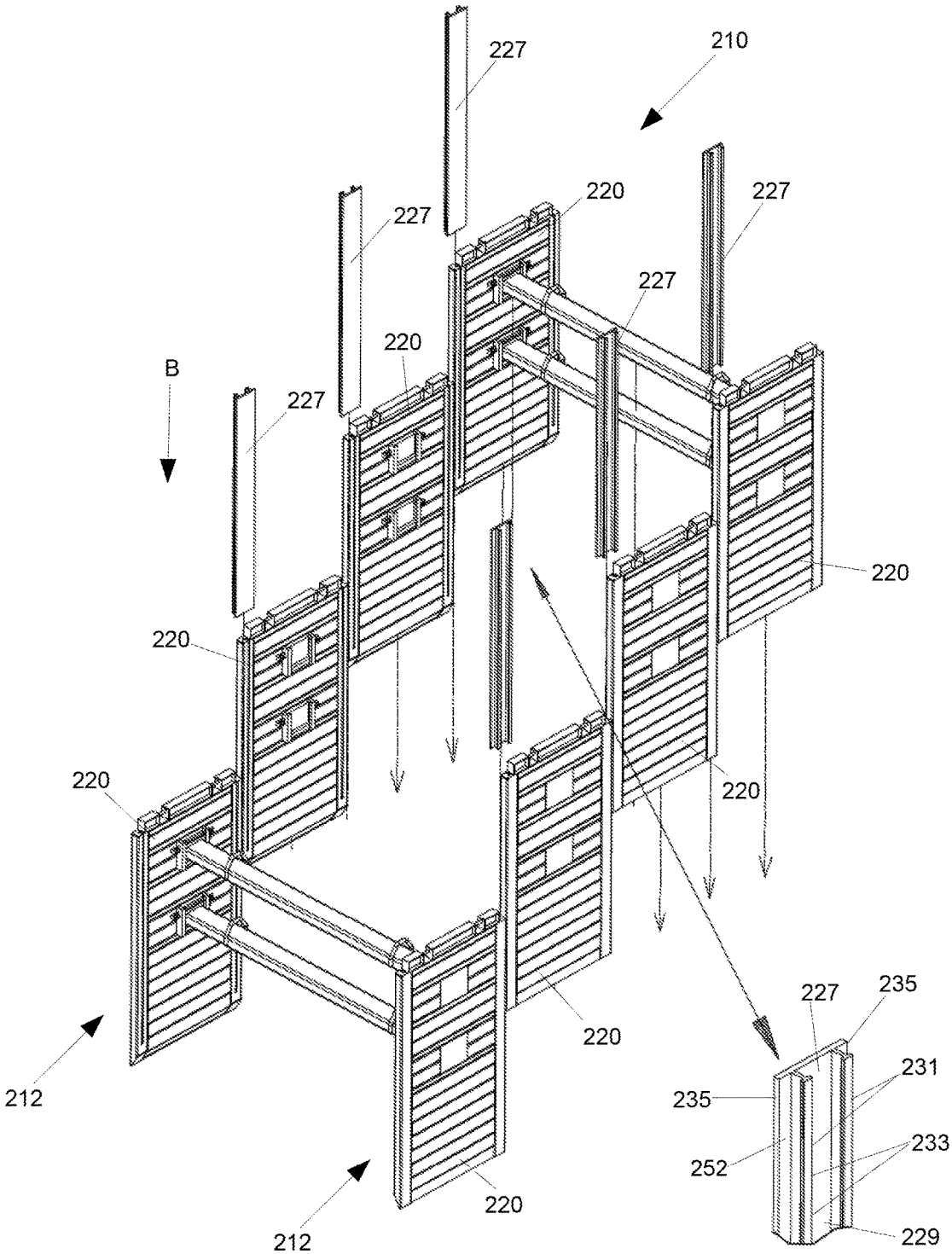
FIG. 24*a* is a perspective view illustrating the trenching system being assembled with elongate coupling members between the adjacent panels to form the system as shown in FIG. 23*a;*
FIG. 24*b* is a part rear perspective view illustrating a removable coupling member for the trenching system as shown in FIG. 24*a;*

The channels or slots 221, best shown in FIG. 23*b*, are correspondingly T-shaped so as to receive and fit with the flanges 333 of the coupling part 252. The slots 221 are open at or toward the top end 230 of the panels 220 to allow the coupling part 252 to be slidably fitted to the slots 221, in the direction as shown by Arrow B in FIG. 24*a* and thereby coupling adjacent panels 220 together.

Similarly to the first example, in this example, in a coupled condition, opposed sides 228 of the panels 220, such as opposing sides 228*a* and 228*b* as shown in FIG. 23*b*, are located very close to or abutting with one another. In this arrangement, the removable coupling part 252 in the form of the elongate member 227 is generally in tension when wall loads from the trench walls are applied to outer faces 240 of the panels 220 and the opposing sides 228*a* and 228*b* of the panels 120 are in direct contact and compression with one another. Accordingly, when the removable coupling part 252 goes into tension the opposing sides 228*a* and 228*b* of the panels 220 are moved or pivoted toward another and ultimately into compression. The utilisation of the opposing sides 228*a* and 228*b* to take the main compressive load allows the overall system 10 to be relatively lightweight. The T-shaped flanges 333 also assist to provide resistance to bending from the opposing direction when loads are applied to the inner faces 238 of the panels toward the trench walls.

Accordingly, in this example, two or more panels 220 may be coupled to form panel assemblies 212 that substantially remain in shape without folding or pivoting. This allows the panel assemblies 212 to be formed outside of the trench and then lowered into the trench where the panel assemblies 212 may be coupled together with the struts 216. The panel assemblies 212 may also be more easily transported and stored as complete assemblies rather than individual panels 220. The supporting elongate body 229 also serves to cover and extend over the opposing sides 228*a* and 228*b* and slots 221 thereby keeps the releasable coupling arrangement 26 generally covered or sealed in use. The arrangement of the removable coupling part 252 in the form of the elongate member 227 makes it accessible from at least the top 230 or inner face 238 of the panels 220 thereby allowing the removable coupling part 252 to inserted and removed from a position inside of the trench.

In this example, the panels 220, elongate member 227 and struts 216 may be formed from a metal such steel or other suitable material.

Figure 25A:
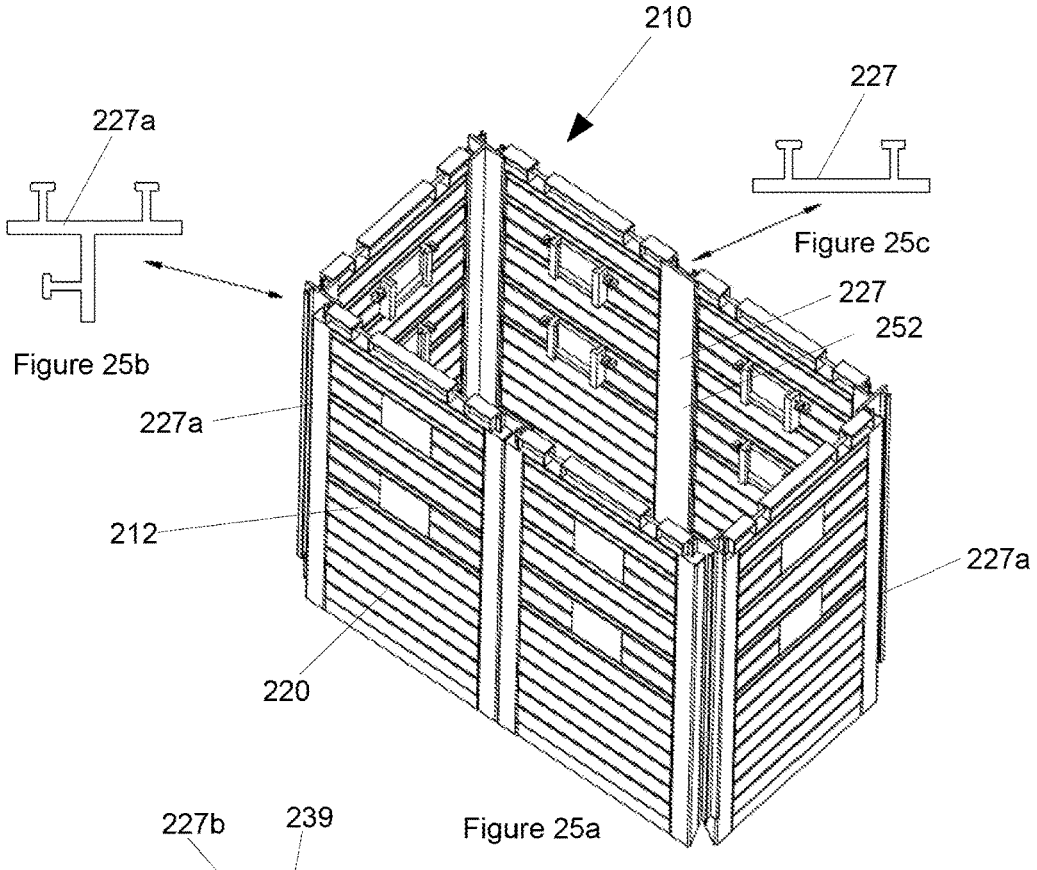
FIG. 25*a* is a perspective view illustrating the trenching system being formed into a box or rectangular shape with an angled coupling as shown in FIG. 25*b;*
Figure 26A:
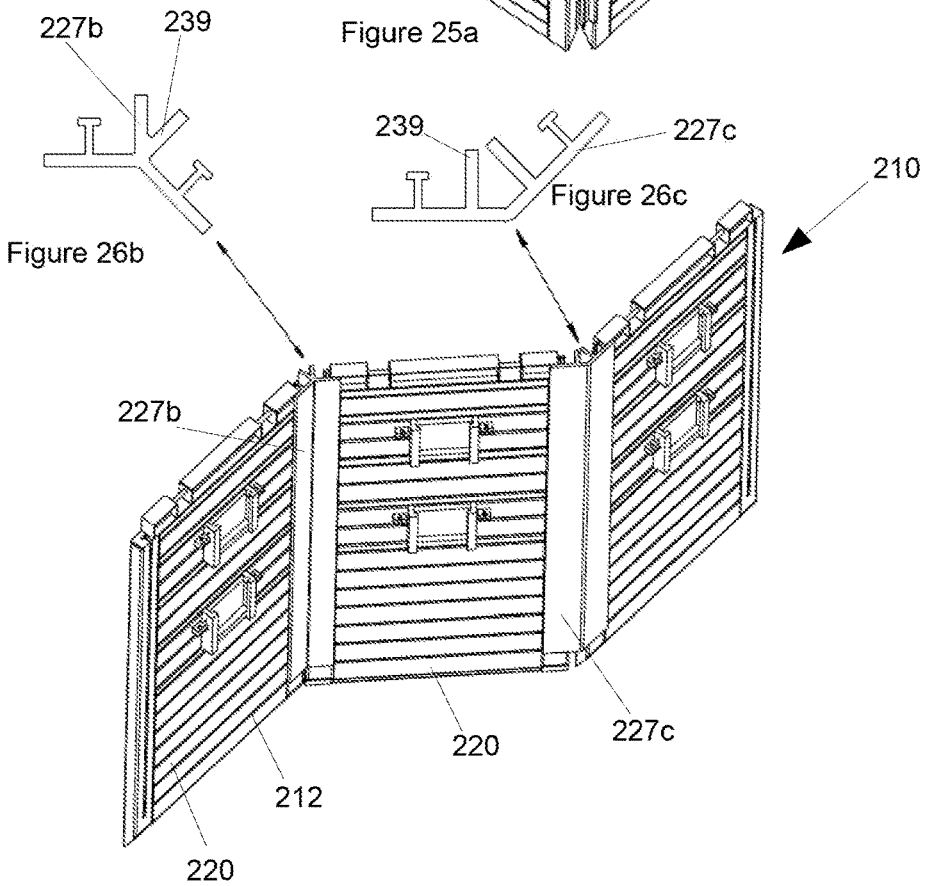
FIG. 26*a* is a perspective view illustrating the trenching system being formed into a non-straight or curved shape with an angled coupling members as shown in FIG. 26*b* and FIG. 26*c;*
Figure 27A:
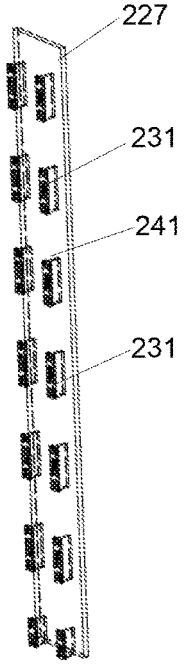
FIG. 27*a* is a perspective view illustrating a further example of an elongate coupling member for coupling adjacent panels that are shown in FIG. 27*a;*
Figure 27B:
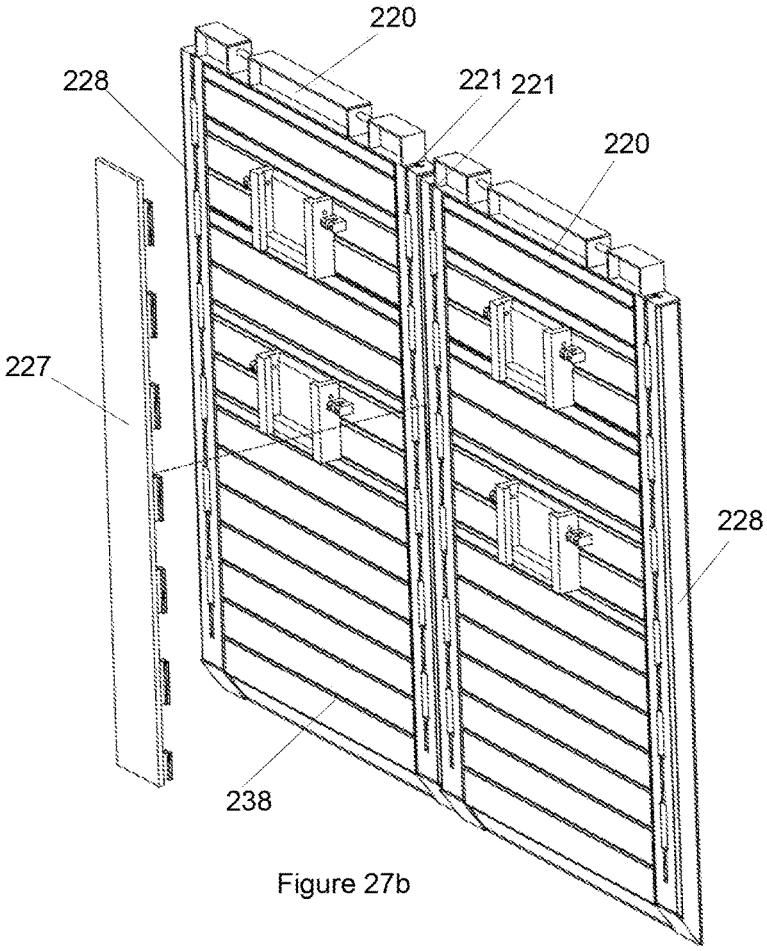
FIG. 27*b* is a perspective view illustrating a further example of the panel assembly arranged to be coupled by the elongate coupling member as shown in FIG. 27*b;*
Figure 27C:
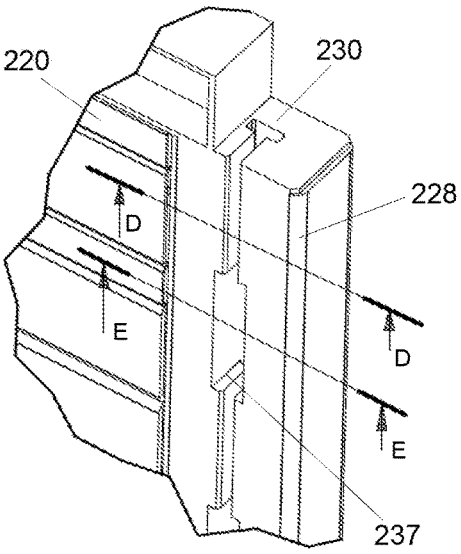
FIG. 27*c* is a detailed perspective view illustrating a slot of one of the panels as shown in FIG. 27*b*, the slot being arranged to receive and fit with the elongate coupling member as shown in FIG. 27*a*.
Figure 27D:
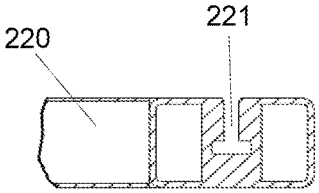
FIGS. 27*d* and 27*e* respectively illustrate sectional views along section D-D and section E-E as shown in FIG. 27*c*.
Figure 27E:
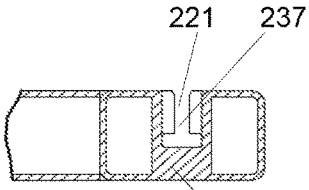

Referring now to FIG. 25*a* to FIG. 26*c*, the removable coupling part 252 in the form of the elongate member 227 as described above, may take a variety of forms such as a corner or angled coupling member 227*a* as shown in FIG. 25*b* that allow panels 220 to be formed into a box-like shape and be connected with further panels 220, and an angled connectors 227*b*, 227*c* that may include stiffeners 239 as shown in FIGS. 26*b* and 26*c* that allows the panels 20 to be connected at various angles to one-another. The angled connectors 227*b* and 227*c* preferably define per-determined angles and a variety of angled connectors 227*b* and 227*c* may be provided to accommodate various angles. Accordingly, the same panels 220 may be interchangeably used with a variety of different interchangeable straight and angled connectors in a modular trenching system 10.

Referring now to FIGS. 27*a* to 27*e*, the two-spaced apart coupling parts 231 extending from the elongate body 229 may be provided a discrete intervals with gaps 241 there between, and the channels or slots 221 of the panels 220 may also include likewise spaced apart entry apertures or recesses 237 that allow the coupling projections 331 to be inserted or fitted to the panels 220 directly from the inner panel face 238 and then the coupling parts 231 may be slid downward into the slots 221 where the, preferably, "T-shaped" flanges 233 are received by the correspondingly shaped slots 221 thereby coupling the adjacent panels 220 and 220 together. It is noted that the slots 221 are still open at the top ends 230 of the panel 220 and the elongate member 227 may be also fitted and removed from the top ends 230 of the panel 220 in a similar way to that shown in FIG. 24*a*.

Advantageously, there has been described a trenching system including panel assemblies include a plurality of panels which may be pivotally coupled to one another with a releasable coupling. The panels may be interconnected at a variety of angles and moved into place or retained at various angles to one another using corner posts, wedges and removable couplings of a varied of sizes. Each of the panels are relatively lightweight and the panels may be installed in-situ, which the trench, or out of the trench. The trenching system may also be formed in sections and then multiple sections may be coupled within the trench. Likewise, to disassemble, the panels may be decoupled in-situ, by the manually realisable couplings, or the panels, panel assemblies or entire system may be lifted out of the trench as a single unit. In particular, as the panels may be installed and uninstalled in-situ one-by-one so that the trenching system may be installed by hand on sites where there is no or limited crane access or limited crane capacity.

Accordingly, the trenching system accommodates a wide range of shapes, sizes, assembly configurations and installation conditions. Importantly, the panels are generally interchangeable and may be re-used and reconfigured for different trenches or sections of the trench. This allows a user to purchase the set of interchangeable panels and the required coupling components such as the struts, pins, removable couplings, corner posts and wedges to form the panels into any required shaped or configurations. In some example, the removable couplings are advantageously interchangeable and may be provide in a variety of straight and angled forms.

It is also noted that the trenching system, panel assemblies and panel may be utilised in other applications that are not specifically "trenching". For example, the system, panel assemblies and panel may be utilised to construct isolated wall or barriers that may be required for situation like flood levy banks. Other configurations may also include doubled walling and propping a single wall from the ground.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

The reference in this specification to any known matter or any prior publication is not, and should not be taken to be, an acknowledgment or admission or suggestion that the known matter or prior art publication forms part of the common general knowledge in the field to which this specification relates.

While specific examples of the invention have been described, it will be understood that the invention extends to alternative combinations of the features disclosed or evident from the disclosure provided herein.

Many and various modifications will be apparent to those skilled in the art without departing from the scope of the invention disclosed or evident from the disclosure provided herein.

The claims defining the invention are as follows:

1. A panel assembly for shoring a wall of a trench, the panel assembly including a removable coupling member, a first panel, and a second panel that is releasably attachable in a side-by-side arrangement with the removable coupling member in an installed condition in which outer faces of the first and second panels are locatable against the wall of the trench, wherein the first and second panels each include one or more couplings located at least one of at and adjacent respective an inner faces and toward each of the opposing sides thereof, and wherein the removable coupling member includes an elongate body arranged to extend in width at least partially across the inner faces between the respective couplings and extend in length substantially the entire length of the inner faces, the elongate body having one or more complimentary couplings arranged to slidably couple with the one or more couplings in the installed condition such that the adjacent opposing sides of the panels abut with one another, wherein the elongate body of the removable coupling member has a width arranged to extend relatively wider than the one or more couplings of the inner faces of the first and second panels in the installed condition, wherein the one or more couplings are spaced inwardly from respective opposing sides of the first and second panels, wherein an inner face of the elongate body of the removable coupling member is arranged to substantially abut with respective inner faces of the first and second panels on either side of the one or more couplings, and wherein the removable coupling member is arranged to be actuated from the inner faces and top ends of the first and second panels thereby allowing at least one of coupling and decoupling of the first and second panels from a position within the trench.

2. The panel assembly according to claim 1, wherein the one or more couplings are each provided in the form of at least one of a slot, a channel and a recess adapted to receive and couple with a complimentary arranged one of the complimentary couplings in the installed condition.

3. The panel assembly according to claim 1, wherein the one or more complimentary couplings are each provided in the form of at least one of a slot, a channel and a recess adapted to receive and couple with a complimentary arranged one of the couplings in the installed condition.

4. The panel assembly according to claim 1, wherein the one or more couplings are located continuously along the inside faces of the first and second panels toward the opposing sides thereof and extending substantially between top and bottom ends of the panel.

5. The panel assembly according to claim 1, wherein the one or more couplings are located at a plurality of discrete intervals along the inside faces of the first and second panels toward the opposing sides thereof and extending substantially between top and bottom ends of the panel, the one or more complimentary couplings of the removable coupling member being arranged to simultaneously couple with the one or more couplings at the plurality of discrete intervals.

6. The panel assembly according to claim 1, wherein the one or more complimentary couplings of the elongate body are provided in two parallel and spaced apart rows, the one or more complimentary couplings of each row being discrete and extending substantially between opposing ends of the elongate body.

7. The panel assembly according to claim 1, wherein the one or more couplings of the first and second panels and one or more complimentary couplings of the removable coupling member are arranged such that the removable coupling member is removable only by initial sliding movement in a direction substantially upwardly relative to the first and second panels in the installed condition followed by moving the removable coupling member in a direction away from the inner faces of the first and second panels.

8. The panel assembly according to claim 1, wherein the one or more couplings of the first and second panels and one or more complimentary couplings of the removable coupling member are arranged so slidingly abut with one another when slid downwardly toward the installed condition so as to define an end of travel stop of the removable coupling member.

9. The panel assembly according to claim 1, wherein the elongate body of the removable coupling member is substantially formed from an elongate substantially rectangular flat plate.

10. The panel assembly according to claim 1, wherein the first and second panels are adapted to couple with likewise third and fourth panels located at an opposing wall of the trench with one or more removable struts coupled therebetween.

11. The panel assembly according to claim 10, wherein the first and second panels include sockets in which flanges at opposing ends of the one or more removable struts are receivable, the sockets including opposing vertically arranged channels that stand proud of the inner faces of the panels between which flanges of male ends of the one or more struts are slidably received, the channels being blinded by a ledge on which the male ends are seated in the installed condition, and the channels including apertures arranged to receive a locking pin to secure the one or more removable struts with the respective sockets.

12. A trenching panel for a panel assembly as defined in claim 1.

13. A removable coupling member for a panel assembly as defined in claim 1.

14. The panel assembly according to claim 1, wherein the elongate body of the removable coupling member includes at least two of the one or more complimentary couplings located toward opposing sides of the elongate body and extending substantially between the opposing ends of the elongate body.

15. A panel assembly for shoring a wall of a trench, the panel assembly including a removable coupling member, a first panel, and a second panel that is releasably attachable in a side-by-side arrangement with the removable coupling member in an installed condition in which outer faces of the first and second panels are locatable against the wall of the trench, wherein the first and second panels each include one or more couplings located at least one of at and adjacent respective an inner faces and toward each of the opposing sides thereof, and wherein the removable coupling member includes an elongate body arranged to extend in width at least partially across the inner faces between the respective couplings and extend in length substantially the entire length of the inner faces, the elongate body having one or more complimentary couplings arranged to slidably couple with the one or more couplings in the installed condition such that the adjacent opposing sides of the panels abut with one another, wherein the elongate body of the removable coupling member has a width arranged to extend relatively wider than the one or more couplings of the inner faces of the first and second panels in the installed condition, wherein the one or more couplings are spaced inwardly from respective opposing sides of the first and second panels, wherein an inner face of the elongate body of the removable coupling member is arranged to substantially abut with respective inner faces of the first and second panels on either side of the one or more couplings, wherein the first and second panels are adapted to couple with likewise third and fourth panels located at an opposing wall of the trench with one or more removable struts coupled therebetween, wherein the panel assembly includes sockets in which flanges at opposing ends of the one or more removable struts are receivable, the sockets including opposing vertically arranged channels that stand proud of the inner faces of the panels between which flanges of male ends of the one or more struts are slidably received, the channels being blinded by a ledge on which the male ends are seated in the installed condition, and the channels including apertures arranged to receive a locking pin to secure the one or more removable struts with the respective sockets.

* * * * *